US010012919B2

(12) United States Patent
Matsui et al.

(10) Patent No.: US 10,012,919 B2
(45) Date of Patent: Jul. 3, 2018

(54) TONER, DEVELOPING APPARATUS, AND IMAGE-FORMING APPARATUS

(71) Applicant: CANON KABUSHIKI KAISHA, Tokyo (JP)

(72) Inventors: Takashi Matsui, Mishima (JP); Yuujirou Nagashima, Susono (JP); Keisuke Tanaka, Yokohama (JP); Shohei Tsuda, Suntou-gun (JP); Naoki Okamoto, Mishima (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/631,366

(22) Filed: Jun. 23, 2017

(65) Prior Publication Data

US 2018/0004106 A1 Jan. 4, 2018

(30) Foreign Application Priority Data

Jun. 30, 2016 (JP) ..... 2016-130177

(51) Int. Cl.

| | |
|---|---|
| ***G03G 9/087*** | (2006.01) |
| ***G03G 9/08*** | (2006.01) |
| ***G03G 9/083*** | (2006.01) |
| ***G03G 9/09*** | (2006.01) |
| *G03G 15/02* | (2006.01) |

(52) U.S. Cl.

CPC ..... *G03G 9/0825* (2013.01); *G03G 9/081* (2013.01); *G03G 9/0833* (2013.01); *G03G 9/08708* (2013.01); *G03G 9/08724* (2013.01); *G03G 9/08755* (2013.01); *G03G 9/0904* (2013.01); *G03G 15/0216* (2013.01)

(58) Field of Classification Search

CPC . G03G 9/087; G03G 9/08711; G03G 9/08755
See application file for complete search history.

(56) References Cited

U.S. PATENT DOCUMENTS

| | | | |
|---|---|---|---|
| 4,657,838 | A | 4/1987 | Fukumoto et al. |
| 4,673,631 | A | 6/1987 | Fukumoto et al. |
| 4,710,443 | A | 12/1987 | Tanaka et al. |
| 4,737,432 | A | 4/1988 | Tanaka et al. |
| 4,886,725 | A | 6/1989 | Hyosu et al. |
| 4,839,255 | A | 12/1989 | Tanaka et al. |
| 5,071,727 | A | 12/1991 | Ikeda et al. |
| 5,288,579 | A | 2/1994 | Tanaka et al. |
| 5,306,588 | A | 4/1994 | Tanaka et al. |
| 5,356,749 | A | 10/1994 | Hagiwara et al. |
| 5,508,139 | A | 4/1996 | Tanaka et al. |
| 7,361,400 | B2 | 4/2008 | Shimamura et al. |
| 7,396,626 | B2 | 7/2008 | Fujikawa et al. |
| 7,396,629 | B2 | 7/2008 | Baba et al. |
| 7,611,813 | B2 | 11/2009 | Ida et al. |
| 7,629,100 | B2 | 12/2009 | Okamoto et al. |
| 7,678,523 | B2 | 3/2010 | Hiroko et al. |
| 7,842,446 | B2 | 11/2010 | Yanase et al. |
| 7,923,190 | B2 | 4/2011 | Magome et al. |
| 7,935,467 | B2 | 5/2011 | Dojo et al. |
| 8,114,562 | B2 | 2/2012 | Ishigami et al. |
| 8,298,742 | B2 | 10/2012 | Okamoto et al. |
| 8,426,091 | B2 | 4/2013 | Magome et al. |
| 8,426,094 | B2 | 4/2013 | Magome et al. |
| 8,614,044 | B2 | 12/2013 | Matsui et al. |
| 8,778,585 | B2 | 7/2014 | Matsui et al. |
| 8,841,054 | B2 | 9/2014 | Dojo et al. |
| 8,883,389 | B2 | 11/2014 | Matsui et al. |
| 8,945,805 | B2 | 2/2015 | Baba et al. |
| 9,034,551 | B2 | 5/2015 | Endo et al. |
| 9,046,800 | B2 | 6/2015 | Hotta et al. |
| 9,097,997 | B2 | 8/2015 | Nomura et al. |
| 9,213,250 | B2 | 12/2015 | Nomura et al. |
| 9,213,251 | B2 | 12/2015 | Ohmori et al. |
| 9,217,943 | B2 | 12/2015 | Matsui et al. |
| 9,235,151 | B2 | 1/2016 | Tanaka et al. |
| 9,239,528 | B2 | 1/2016 | Hasegawa et al. |
| 9,261,806 | B2 | 2/2016 | Moribe et al. |

(Continued)

FOREIGN PATENT DOCUMENTS

| | | | |
|---|---|---|---|
| JP | 2014-235361 | A | 12/2014 |
| JP | 2015-052643 | A | 3/2015 |

(Continued)

OTHER PUBLICATIONS

U.S. Appl. No. 15/416,055, filed Jan. 26, 2017, Takashi Matsui.
U.S. Appl. No. 15/629,839, filed Jun. 22, 2017, Shohei Tsuda.
U.S. Appl. No. 15/631,186, filed Jun. 23, 2017, Takashi Matsui.

*Primary Examiner* — Hoa V Le
(74) *Attorney, Agent, or Firm* — Fitzpatrick Cella Harper and Scinto

(57) ABSTRACT

A toner comprising a toner particle containing a binder resin, a colorant, an amorphous polyester, and a crystalline polyester, wherein the binder resin contains a vinyl resin; the amorphous polyester has a monomer unit derived from a linear aliphatic dicarboxylic acid having 6 to 12 carbons, and a monomer unit derived from a dialcohol; the content of the monomer unit derived from a linear aliphatic dicarboxylic acid having 6 to 12 carbons is 10 to 50 mol % with reference to the total monomer units derived from a carboxylic acid in the amorphous polyester; and in a cross section of the toner particle, the vinyl resin constitutes a matrix and the amorphous polyester constitutes domains, and the crystalline polyester is present in the interior of the domains.

14 Claims, 4 Drawing Sheets

(56) References Cited

U.S. PATENT DOCUMENTS

| | | | | |
|---|---|---|---|---|
| 9,285,697 | B2 | 3/2016 | Fukudome et al. | |
| 9,304,422 | B2 | 4/2016 | Matsui et al. | |
| 9,348,246 | B2 | 5/2016 | Magome et al. | |
| 9,354,545 | B2 | 5/2016 | Matsui et al. | |
| 9,442,416 | B2 | 9/2016 | Magome et al. | |
| 9,442,419 | B2 | 9/2016 | Wakabayashi et al. | |
| 9,470,993 | B2 | 10/2016 | Nishikawa et al. | |
| 9,575,425 | B2 | 2/2017 | Naka et al. | |
| 9,581,934 | B2 | 2/2017 | Ito et al. | |
| 9,588,450 | B2 | 3/2017 | Tsuda et al. | |
| 9,606,462 | B2 | 3/2017 | Nomura et al. | |
| 9,658,546 | B2 | 5/2017 | Tanaka et al. | |
| 9,715,188 | B2 | 7/2017 | Terauchi et al. | |
| 2009/0197192 | A1 | 8/2009 | Hiroko et al. | |
| 2014/0322643 | A1* | 10/2014 | Watanabe | G03G 9/0806 430/109.4 |
| 2015/0064616 | A1 | 3/2015 | Sekiguchi et al. | |
| 2015/0125790 | A1 | 5/2015 | Hotta et al. | |
| 2015/0185658 | A1 | 7/2015 | Wakabayashi et al. | |
| 2015/0227067 | A1 | 8/2015 | Hasegawa et al. | |
| 2015/0227068 | A1 | 8/2015 | Sano et al. | |
| 2015/0227069 | A1 | 8/2015 | Sugama et al. | |
| 2016/0041482 | A1 | 2/2016 | Terauchi et al. | |
| 2016/0041484 | A1 | 2/2016 | Tsuda et al. | |
| 2016/0070188 | A1 | 3/2016 | Fujisaki et al. | |
| 2016/0139521 | A1 | 5/2016 | Tsuda et al. | |
| 2016/0266509 | A1 | 9/2016 | Sano et al. | |
| 2016/0378003 | A1 | 12/2016 | Arimura et al. | |
| 2017/0123333 | A1 | 5/2017 | Kuroki et al. | |
| 2017/0160657 | A1 | 6/2017 | Suzumura et al. | |
| 2017/0160660 | A1 | 6/2017 | Hasegawa et al. | |
| 2017/0160661 | A1 | 6/2017 | Suzumura et al. | |
| 2017/0160662 | A1 | 6/2017 | Nagashima et al. | |
| 2018/0004106 | A1* | 1/2018 | Matsui | G03G 9/081 |

FOREIGN PATENT DOCUMENTS

| | | | |
|---|---|---|---|
| JP | 2015-152703 | A | 8/2015 |
| JP | 2016-057382 | A | 4/2016 |

* cited by examiner

TONER, DEVELOPING APPARATUS, AND IMAGE-FORMING APPARATUS

BACKGROUND OF THE INVENTION

Field of the Invention

The present invention relates to a toner used for toner jets and in image-forming methods for the visualization of electrophotographic and electrostatic images. The present invention further relates to a developing apparatus and an image-forming apparatus.

Description of the Related Art

In the past, a printer was frequently used connected to a network and a large number of individuals would then print to this printer. However, in recent years, there has also been strong demand for locating the PC and printer at an individual's desk in order to carry out local printing. Due to this, the space taken up by the printer must be reduced and there is thus strong demand for reducing printer size.

In addition, focusing on the environment in which printers are used, they are being used over a broad range from low-temperature, low-humidity environments to high-temperature, high-humidity environments. Moreover, in regions where large day-to-night temperature variations occur, repetitive exposure to high temperature-to-low temperature sequences (also referred to as heat cycling) can also occur over an extended period of time when the air conditioner is turned off during an extended vacation.

First, primarily downsizing the fixing unit and downsizing the image-forming apparatus are effective when the focus is on reducing the size of a printer. When film fixing is adopted to support downsizing of the fixing unit, simplification of the heat source and apparatus structure is easily achieved and is easily applied. Toner that can be fixed at low pressures with small amounts of heat is required for this film fixing.

In order to reduce the size of the image-forming apparatus, a cleanerless system is preferably adopted for the image-forming apparatus. A cleanerless system lacks a cleaning blade and cleaner container and after transfer recovers the toner remaining on the image-bearing member to the developing device using a toner-carrying member, and as a consequence enables a substantial reduction in the size of the image-forming apparatus.

However, characteristic problems are also present with cleanerless systems. In a cleanerless system, the untransferred toner passes through a charging step and is again recovered into the developing device. Due to this, stress is applied between members not only in the developing step, but also in the charging step and the recovery step, and toner deterioration, i.e., the burying of external additives and toner cracking, can then occur. This toner deterioration, for example, facilitates the occurrence of poor control at the toner control member within the image-forming apparatus and facilitates the production of toner ghosts.

Summarizing the preceding, a toner is required that—even after heat cycling and even when subjected to stress during a durability challenge as in a cleanerless system—exhibits an excellent developing performance and enables fixing at low pressures and small amounts of heat.

Japanese Patent Application Laid-open No. 2015-152703 proposes a toner that has a microfine domain phase based on an amorphous resin. Japanese Patent Application Laid-open No. 2014-235361 provides a toner having an improved low-temperature fixability and an improved heat-resistant storability. The toner in Japanese Patent Application Laid-open No. 2014-235361 is characterized by the dispersion, in a vinyl resin matrix, of fine particles of a crystalline polyester resin dispersed in an amorphous resin in which amorphous polyester segments are chemically bonded to vinyl polymer segments.

SUMMARY OF THE INVENTION

While an improvement in the fixing performance was certainly seen with the invention in Japanese Patent Application Laid-open No. 2015-152703, there was still room for improvement in the developing performance after the application of stress during a durability challenge such as a cleanerless system.

Improvements in the storability and fixing performance were seen with Japanese Patent Application Laid-open No. 2014-235361, but again there was still room for improvement in the developing performance after heat cycling and after the application of stress during a durability challenge such as a cleanerless system.

Thus, as indicated in the preceding, there was still room for investigations and room for improvement with regard to a toner that—even after heat cycling and even when subjected to stress during a durability challenge as in a cleanerless system—would exhibit an excellent developing performance and would be able to support fixing at low pressures and small amounts of heat.

An object of the present invention is to provide a toner that—after heat cycling and/or when exposed to a durability challenge—exhibits a suppression of fogging and has an excellent low-temperature fixability. A further object of the present invention is to provide a developing apparatus and an image-forming apparatus that have this toner.

The present invention is a toner comprising a toner particle containing a binder resin, a colorant, an amorphous polyester, and a crystalline polyester, wherein the binder resin contains a vinyl resin; the amorphous polyester has a monomer unit derived from a linear aliphatic dicarboxylic acid having at least 6 and not more than 12 carbons, and a monomer unit derived from a dialcohol; the content of the monomer unit derived from the linear aliphatic dicarboxylic acid having at least 6 and not more than 12 carbons is at least 10 mol % and not more than 50 mol % with reference to the total monomer units derived from a carboxylic acid in the amorphous polyester; and in a cross section of the toner particle observed with a transmission electron microscope (TEM), the vinyl resin constitutes a matrix and the amorphous polyester constitutes domains and the crystalline polyester is present in the interior of the domains.

The present invention is also a developing apparatus that has a toner that develops an electrostatic latent image formed on an image-bearing member, and a toner-carrying member that carries the toner and transports the toner to the image-bearing member, wherein the toner is the toner described hereabove.

The present invention is also an image-forming apparatus having an image-bearing member, a charging member that charges the image-bearing member, a toner that develops an electrostatic latent image formed on the image-bearing member, and a toner-carrying member that contacts the image-bearing member and transports the toner, the image-forming apparatus recovering, using the toner-carrying member, toner remaining on the image-bearing member after transfer, wherein the toner is the toner described hereabove.

The present invention can thus provide a toner that—after heat cycling and/or when exposed to a durability challenge—exhibits a suppression of fogging and has an excellent low-temperature fixability. The present invention can also provide a developing apparatus and an image-forming apparatus that have this toner.

Further features of the present invention will become apparent from the following description of exemplary embodiments (with reference to the attached drawings).

DESCRIPTION OF THE EMBODIMENTS

Figure 1:
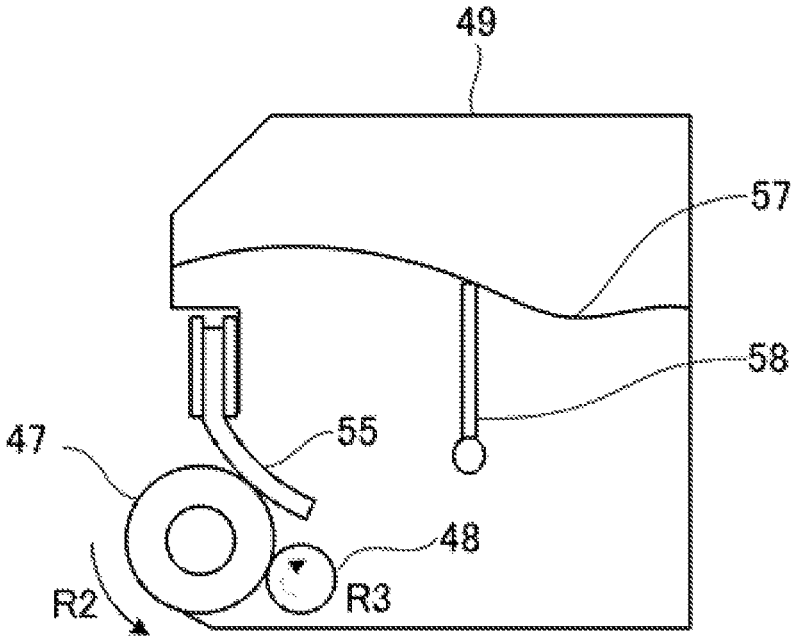
FIG. 1 is a schematic cross-sectional diagram that shows an example of a developing apparatus.

Unless specifically indicated otherwise, expressions such as "at least XX and not more than YY" and "XX to YY" that show numerical value ranges refer in the present invention to numerical value ranges that include the lower limit and upper limit that are the end points.

The toner of the present invention is a toner comprising a toner particle containing a binder resin, a colorant, an amorphous polyester, and a crystalline polyester, wherein the binder resin contains a vinyl resin; the amorphous polyester has a monomer unit derived from a linear aliphatic dicarboxylic acid having at least 6 and not more than 12 carbons, and a monomer unit derived from a dialcohol; the content of the monomer unit derived from the linear aliphatic dicarboxylic acid having at least 6 and not more than 12 carbons is at least 10 mol % and not more than 50 mol % with reference to the total monomer units derived from a carboxylic acid in the amorphous polyester; and in a cross section of the toner particle observed with a transmission electron microscope (TEM), the vinyl resin constitutes a matrix and the amorphous polyester constitutes domains and the crystalline polyester is present in the interior of the domains.

The low-temperature fixability will be considered first. Items that can be used to evaluate the low-temperature fixability are, for example, the rubbing characteristics, tape peeling, and chipping of the solid image. Among these, improving the solid image chipping is an essential item that governs the fixation temperature. In a solid image, the toner layer assumes a densely laid-on state on the media, e.g., paper, and as a consequence a state is assumed in which the transmission of heat to the lower stratum of the toner layer (media side) and to the media, e.g., paper, is impeded. Moreover, not only is the heat transmission impeded, but the transmission of pressure is also impeded at the valleys in the case of media that presents large peaks and valleys, such as, for example, rough paper. As a consequence, when fixing between the toner and media is inadequate when a solid image is formed on and fixed to media that presents large peaks and valleys, such as rough paper, toner then goes with the fixing unit, e.g., the fixing film, and an image is thus obtained in which a portion of the solid image is chipped off.

That is, a toner that can be fixed at low pressures and with small amounts of heat is required in order to improve the solid image chipping with rough paper, which is an item with regard to the low-temperature fixability.

The developing performance after heat cycling, i.e., repetitive exposure to high temperature-to-low temperature sequences over an extended period of time, will now be considered.

When toner is subjected to a heat cycling of repetitive exposure to high temperature-to-low temperature sequences, low molecular weight components present in the interior of the toner particle proceed to outmigrate to the toner particle surface. As a result, for example, the charge control agent, external additive, and so forth present at the toner particle surface are buried, which as a consequence facilitates a decline in the flowability of the toner and in its charging performance. In addition, the charge quantity during development becomes inadequate and the toner undergoes development into non-image areas and so-called fogging is readily produced.

In particular, fogging is readily produced in white areas immediately after a solid image has been formed (also referred to as post-solid-black fogging). Here, when a solid image is formed, the toner turns over in the vicinity of the toner-carrying member and due to this repeated triboelectric charging cannot occur at the toner-carrying member and toner control member for a white area that is a non-image area directly after a solid image has been formed. As a consequence, it is necessary to impart charge to the toner through a single triboelectric charging so as to prevent the toner from developing non-image areas. As a result, in order to charge the toner by a single triboelectric charging at the toner-carrying member and toner control member, it then becomes crucial—even with exposure to heat cycling—to maintain the flowability and charging performance of the toner rather than the charge control agent and/or external additive present on the toner particle surface becoming buried.

That is, in order to suppress post-solid-black fogging after exposure to heat cycling, it becomes crucial to suppress the outmigration to the toner surface of low molecular weight components that are present in the toner particle interior.

The developing performance during the application of stress during repeated use, for example, as in a cleanerless system, will now be considered.

As noted above, when stress is applied between members as in a cleanerless system, toner deterioration, e.g., the burying of external additives and toner cracking, ends up occurring and a reduction in toner flowability readily occurs. As for the developing performance post-heat cycling as described above, the generation of fogging in white areas immediately after the formation of a solid image is facilitated when the toner flowability is reduced and/or deterioration, i.e., toner cracking, occurs.

Thus, in order to improve the developing performance when stress is applied during repeated use, for example, as in a cleanerless system, it becomes crucial to suppress burying of the external additives and toner cracking even when the toner is subjected to stress during repeated use.

On the occasion of detailed investigations, the present inventors found that the constitution of the present invention is essential for suppressing fogging and solid image cracking, as discussed above, after heat cycling and/or upon exposure to repeated use, and for achieving low-temperature fixability.

The present invention is described in detail in the following.

First, the toner of the present invention is a toner that comprises a toner particle containing a binder resin, a colorant, an amorphous polyester, and a crystalline polyester, wherein the binder resin contains a vinyl resin. To the degree that the effects of the present invention are not impaired, a resin known for use as a binder resin may be used in addition to the vinyl resin. The binder resin preferably is a vinyl resin.

When the binder resin contains a vinyl resin, post-solid-black fogging is readily suppressed. Burying of the external additives and toner cracking upon the application of stress during repeated use, as in a cleanerless system, can also be suppressed. Moreover, due to the high resistance, the charge is also readily maintained during triboelectric charging at the toner-carrying member and toner control member.

The vinyl resin is exemplified as follows.

The following can be used, either individually or in combinations of a plurality of species: homopolymers of styrene and its substituted forms such as polystyrene and polyvinyltoluene; styrenic copolymers such as styrene-propylene copolymers, styrene-vinyltoluene copolymers, styrene-vinylnaphthalene copolymers, styrene-methyl acrylate copolymers, styrene-ethyl acrylate copolymers, styrene-butyl acrylate copolymers, styrene-octyl acrylate copolymers, styrene-dimethylaminoethyl acrylate copolymers, styrene-methyl methacrylate copolymers, styrene-ethyl methacrylate copolymers, styrene-butyl methacrylate copolymers, styrene-dimethylaminoethyl methacrylate copolymers, styrene-vinyl methyl ether copolymers, styrene-vinyl ethyl ether copolymers, styrene-vinyl methyl ketone copolymers, styrene-butadiene copolymers, styrene-isoprene copolymers, styrene-maleic acid copolymers, and styrene-maleate ester copolymers; as well as polymethyl methacrylate, polybutyl methacrylate, polyvinyl acetate, polyethylene, polypropylene, polyvinyl butyral, and polyacrylic acid resins. Among the preceding, styrenic copolymers are particularly preferred from the standpoint of, e.g., the developing characteristics and fixing performance. In addition, styrene-butyl acrylate copolymers are more preferred because they facilitate control of the molecular weight and glass transition temperature and facilitate control to a high resistance.

It is essential that the amorphous polyester have a monomer unit derived from a linear aliphatic dicarboxylic acid having at least 6 and not more than 12 carbons, and a monomer unit derived from a dialcohol. It is also essential that the content of the monomer unit derived from linear aliphatic dicarboxylic acid having at least 6 and not more than 12 carbons be at least 10 mol % and not more than 50 mol % with reference to the total monomer units derived from a carboxylic acid in the amorphous polyester.

When the content of units derived from linear aliphatic dicarboxylic acid having at least 6 and not more than 12 carbons is in the indicated range, the softening point of the amorphous polyester is then readily lowered in a state in which the peak molecular weight of the amorphous polyester is increased. This facilitates coexistence between the suppression of solid image chipping and the suppression of durability impairments and outmigration of low molecular weight components due to heat cycling.

Here, "monomer unit" refers to the state of the reacted monomeric substance in the polymer.

The presence of a structure derived from a linear aliphatic dicarboxylic acid having at least 6 and not more than 12 carbons makes it possible for instantaneous melting to occur during fixing and as a consequence facilitates the suppression of solid image chipping. The present inventors hypothesize that the reason for this is as follows: the linear aliphatic dicarboxylic acid segment undergoes folding and thus readily takes on a structure like a pseudocrystalline state.

That is, viewed in terms of the formation of a pseudocrystalline state, it is essential that the number of carbons in the linear aliphatic dicarboxylic acid used in the amorphous polyester of the present invention be at least 6 and not more than 12. When the number of carbons in the linear aliphatic dicarboxylic acid is at least 6, the linear aliphatic dicarboxylic acid segment then readily undergoes folding and due to this a pseudocrystalline state is easily formed and instantaneous melting during fixing can occur, and as a consequence suppression of solid image chipping is facilitated. When the number of carbons in the linear aliphatic dicarboxylic acid is not more than 12, control of the softening point and peak molecular weight is facilitated and as a consequence the suppression of solid image chipping readily coexists with the durability and suppression of outmigration of low molecular weight components induced by heat cycling. The number of carbons is preferably at least 6 and not more than 10.

The softening point is easily lowered when the monomer unit derived from linear aliphatic dicarboxylic acid is at least 10 mol % with reference to the total monomer units derived from a carboxylic acid. On the other hand, at not more than 50 mol % it is difficult to cause a reduction in the peak molecular weight of the amorphous polyester. At least 30 mol % and not more than 50 mol % is more preferred.

The carboxylic acid component for obtaining the amorphous polyester can be exemplified by linear aliphatic dicarboxylic acids having at least 6 and not more than 12 carbons and by other carboxylic acids. Examples of linear aliphatic dicarboxylic acids having at least 6 and not more than 12 carbons are adipic acid, suberic acid, sebacic acid, and dodecanedioic acid. Carboxylic acids other than linear aliphatic dicarboxylic acids having at least 6 and not more than 12 carbons can be exemplified by the following.

Examples of a dibasic carboxylic acid component are maleic acid, fumaric acid, phthalic acid, isophthalic acid, terephthalic acid, succinic acid, glutaric acid, and n-dodecenylsuccinic acid and their anhydrides and lower alkyl esters. Examples of an at least tribasic polybasic carboxylic acid component are 1,2,4-benzenetricarboxylic acid, 2,5,7-naphthalenetricarboxylic acid, pyromellitic acid, and Empol trimer acid and their anhydrides and lower alkyl esters. Terephthalic acid is preferred among the preceding because it enables the maintenance of a high peak molecular weight and facilitates maintenance of the durability.

The alcohol component for obtaining the amorphous polyester can be exemplified by the following in addition to propylene oxide adducts on bisphenol A. Examples of a dihydric alcohol component are ethylene oxide adducts on bisphenol A, ethylene glycol, 1,3-propylene glycol, and neopentyl glycol. Examples of an at least trihydric alcohol component are sorbitol, pentaerythritol, and dipentaerythritol. A single dihydric alcohol component can be used by itself or a combination of a plurality of compounds can be used, and a single at least trihydric alcohol can be used by itself or a combination of a plurality of compounds can be used.

The amorphous polyester can be produced by an esterification reaction or transesterification reaction using the aforementioned alcohol component and carboxylic acid component. In order to accelerate the reaction, a known esterification catalyst, such as dibutyltin oxide, may be used as appropriate in the polycondensation.

The molar ratio between the carboxylic acid component and alcohol component (carboxylic acid component/alcohol component) that are the starting monomers for the amorphous polyester is preferably at least 0.60 and not more than 1.00.

Viewed from the standpoint of the fixing performance and heat-resistant storability, the glass transition temperature (Tg) of the amorphous polyester is preferably at least 45° C. and not more than 75° C.

The glass transition temperature (Tg) can be measured with a differential scanning calorimeter (DSC).

The peak molecular weight (Mp(P)) of the amorphous polyester is preferably at least 8,000 and not more than 13,000 and the softening point is preferably at least 85° C. and not more than 105° C.

When the peak molecular weight (Mp(P)) is at least 8,000, the toner deterioration during long-term use and the outmigration of low molecular weight components induced by heat cycling are then readily suppressed. When the peak molecular weight (Mp(P)) is not more than 13,000, instantaneous melting can then occur during fixing and as a consequence solid image chipping is readily suppressed. Mp(P) is more preferably at least 9,000 and not more than 12,000.

When the softening point of the amorphous polyester is at least 85° C., the toner deterioration during long-term use and the outmigration of low molecular weight components induced by heat cycling are then readily suppressed. When the softening point is not more than 105° C., instantaneous melting can then occur during fixing and as a consequence solid image chipping is readily suppressed. The softening point is more preferably at least 90° C. and not more than 100° C.

In order to control the peak molecular weight and softening point of the amorphous polyester into the preferred ranges, the use is preferred of a dialcohol component and a carboxylic acid component that contains, with reference to the total carboxylic acid component, at least 10 mol % and not more than 50 mol % of linear aliphatic dicarboxylic acid having at least 6 and not more than 12 carbons.

The amorphous polyester preferably also has, in terminal position, a structure derived from at least one selected from the group consisting of aliphatic monocarboxylic acids having a peak value for the number of carbons of at least 25 and not more than 102 and aliphatic monoalcohols having a peak value for the number of carbons of at least 25 and not more than 102 (these two are also collectively referred to below as the "long-chain monomer"). These long-chain monomers are preferably condensed in the terminal position.

Specifically, when a carboxyl group is present in terminal position on the amorphous polyester prior to bonding with the long-chain monomer, a bond is produced by carrying out a condensation reaction with a monoalcohol. When a hydroxy group is present in terminal position on the amorphous polyester prior to bonding with the long-chain monomer, a bond is produced by carrying out a condensation reaction with a monocarboxylic acid.

Here, "terminal position" also includes the terminal position on the branch chain when the amorphous polyester has a branched chain. In a preferred embodiment of the present invention, the amorphous polyester has a branched chain and the long-chain monomer is condensed in terminal position on the branch chain.

An alkyl segment can be introduced in the terminal position of the amorphous polyester by bonding the long-chain monomer in the terminal position of the amorphous polyester. Due to the influence of the alkyl segment, the affinity with the crystalline polyester, described below, can be increased and the development of a lamellar structure is facilitated, and as a consequence the toner deterioration during long-term use and the outmigration of low molecular weight components induced by heat cycling are then readily suppressed.

Moreover, increasing the affinity with the crystalline polyester is facilitated by having the peak value for the number of carbons in the aliphatic monocarboxylic acid and aliphatic monoalcohol be at least 25 and not more than 102, and as a consequence the toner deterioration during long-term use and the outmigration of low molecular weight components induced by heat cycling are then readily suppressed. The peak value for the number of carbons in the aliphatic monocarboxylic acid and aliphatic monoalcohol is more preferably at least 25 and not more than 50.

Here, the "peak value for the number of carbons" is the number of carbons calculated from the main peak molecular weight of the long-chain monomer.

The long-chain monomer used by the present invention is obtained industrially by the alcohol-modification or acid-modification of an aliphatic hydrocarbon starting material. With regard, for example, to alcohol-modified products, it is known that conversion to the alcohol can be carried out by the liquid-phase oxidation of an aliphatic hydrocarbon having at least 25 and not more than 102 carbons using a molecular oxygen-containing gas in the presence of a catalyst such as boric acid, boric anhydride, or meta-boric acid. The amount of addition of the catalyst that is used is preferably 0.01 to 0.5 mol per 1 mol of the starting aliphatic hydrocarbon.

Oxygen, air, and these diluted over a broad range with an inert gas can be used as the molecular oxygen-containing gas injected into the reaction system, but the oxygen concentration is preferably 3% to 20%. The reaction temperature is at least 100° C. and not more than 200° C.

An unmodified component may also be produced in each case during the modification of the long-chain monomer with alcohol or acid. In order to prevent the heat cycling-induced outmigration of this unmodified component to the toner surface, the modification rate of the aliphatic hydrocarbon component is preferably at least 85% and more preferably at least 90%. The charging performance can be improved by this.

The unmodified aliphatic hydrocarbon component can be removed and controlled by optimizing the reaction conditions to improve the modification rate and by carrying out a purification process after the modification reaction.

It is essential that, in a cross section of the toner particle observed with a transmission electron microscope (TEM), the vinyl resin constitutes a matrix and the amorphous polyester constitutes domains.

First, as noted above, with a vinyl resin it is easier to increase the molecular weight, for the case of obtaining the same glass transition temperature (Tg), than with an amorphous polyester. In addition, during triboelectric charging, providing a polarity like that of the ester group is more difficult and a higher resistance is thus more easily provided. Due to this, a fogging-suppressed image can be obtained, post-heat cycling or upon exposure to repeated use, by having the vinyl resin constitute a matrix.

Moreover, it was discovered that fogging suppression can be made to coexist with suppression of solid image chipping by having the vinyl resin constitute a matrix and having the amorphous polyester constitute domains.

This is due to the domain portion being able to melt during fixing by having the amorphous polyester constitute the domains. In comparison to the vinyl resin, the amorphous polyester tends to provide a higher toner-to-toner adhesiveness and a higher adhesiveness between the toner and the media, e.g., paper. In addition, the softening point tends to be more easily lowered with the amorphous polyester than with the vinyl resin. Due to this, the suppression of solid image chipping is made possible by the melting of the domains in the toner.

Adjustment in order to have the amorphous polyester constitute domains as indicated can be made by controlling the acid value and hydroxyl value of the amorphous polyester, having an oleophilic segment (alkyl segment) derived from the aforementioned long-chain monomer in molecular chain terminal position on the amorphous polyester, controlling the softening points of the amorphous polyester and toner, and/or controlling the annealing conditions during toner production.

The present inventors additionally discovered that, through the presence of a crystalline polyester component in the interior of the amorphous polyester domains, the low-temperature fixability is very substantially improved, the solid image chipping can be suppressed, and the fogging can be suppressed post-heat cycling or for the case of exposure to repeated use.

The present inventors hold as follows for the reason for this.

In order to bring about an improvement in the fixing performance, as described above it is necessary that the amorphous polyester domains in the toner particle undergo melting and bring about an improvement in the toner-to-toner adhesiveness and the adhesiveness between the toner and the media, e.g., paper. Having a crystalline polyester component be present in the amorphous polyester domains here makes it possible to bring about an instantaneous melting of the domains when heat is applied during fixing. The present inventors think that this occurs because the crystalline polyester component, which exhibits a sharp melt property to a high degree, is—due to its presence in the amorphous polyester domains—effectively compatible with the amorphous polyester. In addition, the crystalline polyester tends to have a higher molecular weight than the conventional plasticizing waxes. The present inventors think that, due to this, the melted crystalline polyester also raises the adhesiveness with the media, e.g., paper, and due to this the solid image chipping can be very substantially suppressed.

The discovery was also made that the fogging, post-heat cycling or upon exposure to repeated use, can be suppressed by the presence of the crystalline polyester component within the amorphous polyester domains.

As noted above, upon exposure to heat cycling the low molecular weight component and so forth tends to outmigrate to the toner particle surface. For example, when present in the binder resin, crystalline polyester also tends to outmigrate to the toner particle surface and this can be a cause of fogging. Therefore, in the present invention, the crystalline polyester is caused to be present in the interior of the amorphous polyester domains.

By having the crystalline polyester be present in the domains, its outmigration into the binder resin is impeded even during exposure to heat cycling, and due to this its outmigration to the toner particle surface is impeded.

It is preferred for the present invention that the crystalline polyester is present in the interior of the amorphous polyester domains and that the amorphous polyester domains have a lamellar structure derived from the crystalline polyester in the interior.

Here, the lamellar structure is a layered structure produced by crystallization by the folding of the molecular chain of a crystalline polymer and is an energetically stable higher order crystalline structure. That is, this means that a crystalline polymer is present within the domains formed by the amorphous polyester component.

By forming a lamellar structure and raising the degree of crystallinity, compatibilization with the amorphous polyester is impeded even upon exposure to heat cycling and suppression of outmigration into the binder resin is further facilitated.

In addition, by bringing about the formation of a lamellar structure, suppression of compatibilization into the binder resin or amorphous polyester is facilitated and as a consequence an increase in the toner hardness is readily obtained. Due to this, suppression of toner deterioration, i.e., burying of the external additive and toner cracking, is facilitated even when stress is applied between members as in a cleanerless system.

Control of the structure of the molecular chain terminals of the amorphous polyester and molecular chain terminals of the crystalline polyester, control of the softening point of the crystalline polyester and/or amorphous polyester, and control of the annealing conditions during toner production are examples of methods for causing the crystalline polyester to be present in the interior of the amorphous polyester domains and for bringing about lamellar structure formation.

The crystalline polyester component in the domains of the toner particle and the lamellar structure due to the crystalline polyester component can be checked by observation of the cross section using a transmission electron microscope (TEM). The following method is a specific example. The particles to be observed are thoroughly dispersed in an epoxy resin that cures at normal temperature, after which a cured resin material is obtained by curing for two days in an atmosphere at a temperature of 40° C. The obtained cured material, either as such or frozen, is converted to thin sections using a microtome equipped with diamond blade. The obtained cured material thin sections are used as samples and are observed with a TEM.

TEM photography is performed at 50,000×, and observation is performed by printing out the photograph and enlarging 3×. When crystalline polyester can be acquired as a raw material, its crystalline structure is observed proceeding as in the previously described method for observing the toner particle cross section with a transmission electron microscope (TEM) and an image of the lamellar structure of the crystal is obtained. These are compared with the lamellar structure in the domains in the toner particle cross section, and the crystalline polyester in the domains can be identified when the error on the interlayer spacing of the lamellae is not more than 10%.

With regard to the procedure for discriminating the amorphous polyester from the crystalline polyester and confirming their presence, amorphous polyester and crystalline polyester are each acquired as the raw material and images are obtained by observation proceeding as for the method for observing the toner particle cross section with a transmission electron microscope (TEM). The amorphous polyester is discriminated from the crystalline polyester based on the contrast in the obtained images and the presence/absence of a lamellar structure.

With regard to the presence of crystalline polyester in the interior of the domains or the presence in the domains of a lamellar structure derived from crystalline polyester, the contours of the domains in the toner particle cross section obtained with a transmission electron microscope (TEM) are drawn, thereby pointing out the presence of crystalline polyester, or the presence of a crystalline polyester-derived lamellar structure, within the contour (including on the contour).

The condition is regarded as satisfied if crystalline polyester, or a lamellar structure derived from crystalline polyester, is present in the interior in at least 50% of all the domains.

The peak molecular weight (Mp(T)) for the toner of the present invention is preferably at least 15,000 and not more than 30,000. The suppression of toner deterioration during long-term use is facilitated when the peak molecular weight (Mp(T)) for the toner is at least 15,000. In addition, a retardation of melting during fixing is suppressed when the peak molecular weight (Mp(T)) for the toner is not more than 30,000, which is thus preferred.

The content of the amorphous polyester, per 100 mass parts of the binder resin, is preferably at least 5.0 mass parts and not more than 30.0 mass parts. At least 7.0 mass parts and not more than 20.0 mass parts is more preferred.

When the amorphous polyester content is at least 5.0 mass parts, instantaneous melting during fixing can then occur and as a consequence the suppression of solid image chipping is facilitated. When, on the other hand, the content is not more than 30.0 mass parts, toner deterioration during long-term use and the outmigration of low molecular weight components induced by heat cycling are then readily suppressed.

The crystalline polyester will now be described.

Viewed from the standpoint of increasing the crystallinity, preferably aliphatic diol having 6 to 18 carbons is used for the alcohol component used as a starting monomer for the crystalline polyester. Among these, aliphatic diols having 6 to 12 carbons are preferred from the standpoint of the fixing performance and heat-resistant stability. The aliphatic diols can be exemplified by 1,6-hexanediol, 1,7-heptanediol, 1,8-octanediol, 1,9-nonanediol, 1,10-decanediol, 1,11-undecanediol, and 1,12-dodecanediol. Viewed from the standpoint of further increasing the crystallinity of the polyester, the content of this aliphatic diol is preferably 80 to 100 mol % in the alcohol component.

The alcohol component for obtaining the crystalline polyester may contain a polyhydric alcohol component other than the aforementioned aliphatic diol. Examples are aromatic diols, e.g., alkylene oxide adducts on bisphenol A, as given by formula (1) below, including polyoxypropylene adducts on 2,2-bis(4-hydroxyphenyl)propane, polyoxyethylene adducts on 2,2-bis(4-hydroxyphenyl)propane, and so forth; and at least trihydric alcohols such as glycerol, pentaerythritol, and trimethylolpropane.

(1)

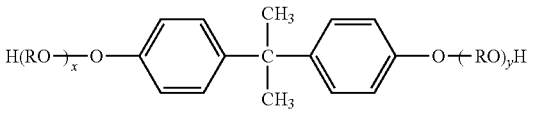

(In the formula, R is the ethylene or propylene group; x and y are each integers equal to or greater than 0; and the average value of x+y is 0 to 10.)

Viewed from the standpoint of increasing the crystallinity, preferably aliphatic dicarboxylic acids having 6 to 18 carbons are used for the carboxylic acid component used for the crystalline polyester. Among these, aliphatic dicarboxylic acids having 6 to 12 carbons are preferred from the standpoint of the fixing performance of the toner and its heat-resistant stability. The aliphatic dicarboxylic acid compounds can be exemplified by octanedioic acid, nonanedioic acid, decanedioic acid, undecanedioic acid, and dodecanedioic acid. The content of aliphatic dicarboxylic acid having 6 to 18 carbons is preferably 80 to 100 mol % in the carboxylic acid component.

The carboxylic acid component for obtaining the crystalline polyester may contain a carboxylic acid component other than the aforementioned aliphatic dicarboxylic acid. Examples here are aromatic dicarboxylic acids and at least tribasic aromatic polybasic carboxylic acids, but there is no particular limitation to these. The aromatic dicarboxylic acids also include derivatives of aromatic dicarboxylic acids. Preferred specific examples of aromatic dicarboxylic acids are aromatic dicarboxylic acids such as phthalic acid, isophthalic acid, and terephthalic acid and their anhydrides and alkyl (1 to 3 carbons) esters. The alkyl group in these alkyl esters can be exemplified by the methyl group, ethyl group, propyl group, and isopropyl group. The at least tribasic polybasic carboxylic acid compounds can be exemplified by aromatic carboxylic acids such as 1,2,4-benzenetricarboxylic acid (trimellitic acid), 2,5,7-naphthalenetricarboxylic acid, and pyromellitic acid and derivatives such as their anhydrides and alkyl (1 to 3 carbons) esters.

Viewed from the standpoint of the low-temperature fixability of the toner, the crystalline polyester has a melting point, as determined from the endothermic peak measured during temperature ramp-up measurement with a differential scanning calorimeter (DSC), preferably of at least 60° C. and not more than 120° C. and more preferably of at least 70° C. and not more than 90° C.

The acid value of the crystalline polyester is preferably at least 2 mg KOH/g and not more than 40 mg KOH/g viewed from the standpoint of obtaining excellent charging characteristics for the toner. The hydroxyl group value is preferably at least 2 mg KOH/g and not more than 40 mg KOH/g viewed from the standpoint of the fixing performance and storage stability.

The crystalline polyester of the present invention preferably has as its main component a polyester that has, in terminal position, a structure (crystal nucleating agent) derived from an acid monomer selected from lauric acid, stearic acid, and behenic acid. Here, main component indicates that the content thereof is at least 50 mass %.

With regard to the crystalline polyester crystalline component in toner, generally a crystal nucleus is produced followed by crystal growth. By having, in the present invention, a crystal nucleating agent in terminal position on the crystalline polyester molecular chain, crystallization in segments capable of taking on a crystalline structure can be induced and crystallization of the crystalline polyester—and particularly the nucleating action of forming crystal nuclei—can be promoted.

The crystal nucleating agent segment is preferably a segment with a faster crystallization rate than the crystalline polyester. From the standpoint of a fast crystallization rate, preferably the main chain contains a hydrocarbon segment and is a structure derived from a compound that has an at least monofunctional functional group that can react with the terminal of the crystalline polyester resin molecule, and more preferably has a structure derived from an acid monomer selected from lauric acid, stearic acid, and behenic acid.

The formation of a lamellar structure is facilitated by the presence of such a crystal nucleating agent segment. In addition, interaction with the amorphous polyester having a long-chain monomer-derived terminal, supra, is strengthened and the presence of the crystalline polyester in the amorphous polyester domains is facilitated.

Toner deterioration during long-term use and the outmigration of low molecular weight components induced by heat cycling are also readily suppressed.

Viewed from the standpoint of raising the crystallization rate, the content of the crystal nucleating agent segment in the crystalline polyester, considered with reference to the total monomer units in the crystalline polyester, is preferably at least 0.1 mol % and not more than 7.0 mol % and is more preferably at least 0.2 mol % and not more than 5.0 mol %. At at least 0.1 mol %, the crystallization rate is fast, compatibilization between the crystalline polyester and amorphous polyester is impeded, the toner has a suitable glass transition temperature (Tg), and the stability of the toner durability is improved. At not more than 7.0 mol %, the degree of crystallinity is suitable, compatibilization between the crystalline polyester and amorphous polyester during fixing is facilitated, and a satisfactory fixing performance is obtained.

The following analysis can be used to determine whether a crystal nucleating agent segment is bonded to the crystalline polyester molecular chain.

A sample solution is prepared by exactly weighing out 2 mg of the sample and adding this to 2 mL of chloroform and dissolving. The crystalline polyester is used as the resin sample; however, when acquisition of the crystalline polyester is problematic, the crystalline polyester-containing toner can also be used instead as the sample. 20 mg of 2,5-dihydroxybenzoic acid (DHBA) is then exactly weighed out and 1 mL of chloroform is added and dissolution is carried out to prepare a matrix solution. In addition, 3 mg of sodium trifluoroacetate (NaTFA) is exactly weighed out, 1 mL of acetone is added, and dissolution is carried out to prepare an ionization assistant solution.

The measurement sample is made by mixing 25 μL of the thusly prepared sample solution, 50 μL of the thusly prepared matrix solution, and 5 μL of the thusly prepared ionization assistant solution, dripping this onto a sample plate for MALDI analysis, and drying. The mass spectrum is obtained using a MALDI-TOF MS (Reflex III, Bruker Daltonics) as the analytical instrumentation. The individual peaks in the oligomer region ($m/Z \leq 2{,}000$) in the obtained mass spectrum are assigned and the determination is made of the presence/absence of a peak corresponding to a composition in which a crystal nucleating agent is bonded at the molecular terminal.

The content of the crystalline polyester, per 100 mass parts of the binder resin, is preferably at least 3.0 mass parts and not more than 15.0 mass parts and more preferably at least 3.0 mass parts and not more than 10.0 mass parts. Suppression of solid image chipping is facilitated at at least 3.0 mass parts. At not more than 15.0 mass parts, toner deterioration during long-term use and the heat cycling-induced outmigration of low molecular weight components are also readily suppressed.

In a cross section of the toner particle observed with a transmission electron microscope (TEM), the proportion of the amorphous polyester domains present in the region within 25% of the distance, from the contour of the cross section, between the contour and the center point of the cross section, is preferably at least 30 area % and not more than 70 area % with reference to the total area of the amorphous polyester domains. At least 45 area % and not more than 70 area % is more preferred.

Having the percentage for the area of the amorphous polyester domains present within 25% of the distance, from the contour of the toner particle section, between the contour and the center point of the cross section (also referred to below as the "25% area ratio") be at least 30 area % and not more than 70 area % is preferred because this suppresses solid image chipping and facilitates the appearance of coexistence between suppression of toner deterioration during long-term use and suppression of the heat cycling-induced outmigration of low molecular weight components.

Toner deterioration during long-term use and the heat cycling-induced outmigration of low molecular weight components are readily suppressed by having the vinyl resin form a matrix in the vicinity of the toner particle surface. In addition, having the amorphous polyester form a plurality of domains in the vicinity of the toner particle surface is preferred because this makes it possible for instantaneous melting to occur during fixing, which as a consequence facilitates the suppression of fixation tailing.

Based on the preceding, when the 25% area ratio is at least 30 area %, instantaneous melting can then occur during fixing and due to this solid image chipping is readily suppressed. In addition, the 25% area ratio is preferably not more than 70 area % because this facilitates suppression of toner deterioration during long-term use and suppression of the heat cycling-induced outmigration of low molecular weight components.

The proportion of the amorphous polyester domains present in the region within 50% of the distance, from the contour of the cross section, between the contour and the center point of the cross section, is preferably at least 80 area % and not more than 100 area % with reference to the total area of the domains. At least 90 area % and not more than 100 area % is more preferred.

When the percentage for the area of the amorphous polyester domains present within 50% of the distance, from the contour of the toner particle cross section, between the contour and the center point of the cross section (also referred to below as the "50% area ratio") is at least 80 area %, instantaneous melting can occur during fixing and due to this the low-temperature fixability is excellent and solid image chipping is readily suppressed. In addition, this specification that the domains are present at at least 80 area % can also be considered as meaning that the occurrence of the domains in the region from the center point of the toner particle to 50% from the contour of the toner particle cross section is not more than 20 area %. When such a condition holds, the softening point of the toner is readily improved and the resistance to brittleness by the toner is readily improved. As a consequence, the deterioration caused by repeated use can be suppressed and post-black fogging during long-term use is readily suppressed.

The area of the amorphous polyester domains present within 25% of the distance, from the contour of the cross section, between the contour and the center point of the cross section, preferably is at least 1.05 times the area of the amorphous polyester domains present at 25% to 50% of the distance, from the contour of the cross section, between the contour and the center point of the cross section. This indicates that the distribution of the domains are skewed toward the toner particle surface. By skewing the distribution of the domains toward the toner particle surface, instantaneous melting during fixing can then occur and as a consequence the low-temperature fixability becomes excellent and solid image chipping is readily suppressed.

(The area of the amorphous polyester domains present within 25% of the distance, from the contour of the toner particle cross section, between the contour and the center point of the cross section/area of the amorphous polyester domains present at 25% to 50% of the distance, from the contour of the cross section, between the contour and the center point of the cross section (also referred to below as the domain area ratio)) more preferably is at least 1.20 times. On the other hand, while the upper limit is not particularly limited, it is preferably not more than 3.00 times.

Adjustment in order to have the amorphous polyester form domains as indicated in the vicinity of the toner particle surface can be made by controlling the acid value and hydroxyl value of the amorphous polyester, having an oleophilic segment (alkyl segment) derived from the aforementioned long-chain monomer in molecular chain terminal position on the amorphous polyester, controlling the softening points of the amorphous polyester and toner, and/or controlling the annealing conditions during toner production.

The number-average diameter of the domains formed by the amorphous polyester is preferably at least 0.3 μm and not more than 3.0 μm and is more preferably at least 0.3 μm and not more than 2.0 μm.

When the number-average diameter of the domains is at least 0.3 μm, this facilitates the occurrence of a region having a lamellar structure formed by the crystalline polyester. In addition, the state of occurrence of the domains is readily controlled when the number-average diameter of the domains is not more than 3.0 μm.

With regard to control of the domain diameter, adjustments can be carried out by controlling the acid value and hydroxyl value of the amorphous polyester, by having an oleophilic segment derived from the long-chain monomer be present in molecular chain terminal position on the amorphous polyester, by controlling the softening points of the amorphous polyester and toner, and by controlling the annealing conditions during toner production.

The acid value Av of the amorphous polyester is preferably at least 1.0 mg KOH/g and not more than 10.0 mg KOH/g. When the acid value Av of the amorphous polyester is in the indicated range, the 25% area ratio, the 50% area ratio, and the domain area ratio are then readily controlled into the preferred ranges of the present invention.

The hydroxyl value OHv of the amorphous polyester is preferably not more than 40.0 mg KOH/g. When the hydroxyl value OHv of the amorphous polyester is not more than 40.0 mg KOH/g, the amorphous polyester then readily forms domains in the vicinity of the toner surface, and this is thus preferred. An oleophilic segment (alkyl segment) derived from the aforementioned long-chain monomer is preferably present in molecular chain terminal position on the amorphous polyester in order to control the acid value Av of the amorphous polyester to at least 1.0 mg KOH/g and not more than 10.0 mg KOH/g and in order to control the hydroxyl value OHv to not more than 40.0 mg KOH/g.

Having an oleophilic segment be present in molecular chain terminal position on the amorphous polyester is preferred because this facilitates interaction with the vinyl resin, as a consequence of which control of the size and location of occurrence of the domains is facilitated and interaction with the crystalline polyester preferably used in the present invention is increased and as a consequence a lamellar structure then readily develops in the domain interior.

The following formula (1) is preferably satisfied where S85 is the peak intensity originating from the vinyl resin of the toner and S211 is the peak intensity originating from the amorphous polyester, in each instance as obtained by time-of-flight secondary ion mass spectrometry (TOF-SIMS).

$$0.30 \leq S211/S85 \leq 3.00 \quad \text{formula (1)}$$

Time-of-flight secondary ion mass spectrometry (TOF-SIMS) can provide data for several nanometers from the toner particle surface and thus can identify the constituent materials for the surfacemost layer of the toner particle. In a preferred construction the amorphous polyester has a unit derived from bisphenol A as the alcohol component, and S211 is thus a peak originating from this bisphenol A. In addition, in a preferred construction the vinyl resin is a styrene-butyl acrylate copolymer as indicated above, and S85 is thus a peak originating from this butyl acrylate.

When S211/S85 is at least 0.30, the amorphous polyester is present at the surfacemost side of the toner particle and due to this the toner can undergo instantaneous melting during fixing.

In addition, when S211/S85 is not more than 3.00, toner deterioration during long-term use and the heat cycling-induced outmigration of low molecular weight components are readily suppressed.

The weight-average particle diameter (D4) of the toner is preferably at least 5.0 μm and not more than 12.0 μm and is more preferably at least 5.5 μm and not more than 11.0 μm. When the weight-average particle diameter (D4) is in the indicated range, an excellent flowability is obtained and triboelectric charging at the control member is facilitated and as a consequence post-black fogging can be suppressed and faithful development at the latent image can be achieved.

The average circularity of the toner preferably is at least 0.950. The toner assumes a spherical or near-spherical shape at an average circularity for the toner of at least 0.950, and the flowability is then excellent, a uniform triboelectric charging performance is readily obtained, the suppression of post-black fogging is facilitated, and the transferability is also readily improved.

The glass transition temperature (Tg) of the toner is preferably at least 40.0° C. and not more than 70.0° C. When the glass transition temperature is in the indicated range, improvements in the storage stability and durability of the toner can be brought about while maintaining an excellent fixing performance.

The glass transition temperature (Tg) can be measured using a differential scanning calorimeter (DSC).

The softening point of the toner is preferably at least 110° C. and not more than 140° C. and is more preferably at least 120° C. and not more than 140° C. For systems in which stress is readily applied to the toner between members, as in a cleanerless system, the softening point of the toner is preferably controlled in order to suppress toner deterioration. A softening point for the toner of at least 110° C. is preferred because in this case toner deterioration, i.e., burying of external additives and toner cracking, can also be suppressed at normal temperatures. On the other hand, a softening point for the toner of not more than 140° C. is preferred when the fixing performance is considered. A toner softening point of not more than 140° C. is preferred because in this case deformation can occur upon the application of heat and pressure from the fixing unit.

In order to optimize the softening point of the toner, control can be exercised through adjustment of the molecular weight of the toner, the amount of THF-insoluble matter in the toner, and the type, amount, and state of dispersion of a plasticizer such as wax.

As necessary, the toner particle may contain a charge control agent in order to enhance the charging characteristics. While various charge control agents can be used, charge control agents that provide a fast charging speed and that can stably maintain a certain charge quantity are particularly preferred. Moreover, when the toner is produced using a polymerization method as described below, a charge control agent that has little ability to inhibit the polymerization and that is substantially free of material soluble in the aqueous dispersion medium is particularly preferred.

The charge control agent can be exemplified by metal compounds of aromatic carboxylic acids such as salicylic acid, alkylsalicylic acid, dialkylsalicylic acid, naphthoic acid, and dicarboxylic acids;

metal salts and metal complexes of azo dyes and azo pigments;

polymer compounds having a sulfonic acid group or carboxylic acid group in side chain position;

boron compounds;

urea compounds;

silicon compounds; and calixarene.

When added to the interior of the toner particle, the amount of use of these charge control agents, per 100 mass parts of the binder resin, is preferably at least 0.1 mass parts and not more than 10.0 mass parts and is more preferably at least 0.1 mass parts and not more than 5.0 mass parts. When added to the outside of the toner particle, and considered per 100 mass parts of the toner base particles, at least 0.005 mass parts and not more than 1.000 mass parts is preferred and at least 0.010 mass parts and not more than 0.300 mass parts is more preferred. The toner base particles are the particles prior to the addition of the external additive.

The toner particle may contain a release agent in order to enhance the fixing performance. The content of the release agent in the toner particle, per 100 mass parts of the binder resin, is preferably at least 1.0 mass parts and not more than 30.0 mass parts and is more preferably at least 3.0 mass parts and not more than 25.0 mass parts.

When the release agent content is at least 1.0 mass parts, solid image chipping is then readily suppressed. When it is not more than 30.0 mass parts, toner deterioration during long-term use and the heat cycling-induced outmigration of low molecular weight components are then readily suppressed.

The release agent can be exemplified by petroleum-based waxes such as paraffin wax, microcrystalline wax, and petrolatum, and derivatives thereof;

montan wax and derivatives thereof;

hydrocarbon waxes provided by the Fischer-Tropsch method and derivatives thereof;

polyolefin waxes such as polyethylene, and derivatives thereof; and natural waxes such as carnauba wax and candelilla wax, and derivatives thereof. The derivatives include the oxides and block copolymers and graft modifications with vinyl monomers. The following, for example, can also be used as the release agent: higher aliphatic alcohols, fatty acids such as stearic acid and palmitic acid, acid amide waxes, ester waxes, hardened castor oil and derivatives thereof, plant-derived waxes, and animal waxes.

Among these release agents, the use of paraffin waxes is preferred because they facilitate suppression of solid image chipping and facilitate suppression of toner deterioration during long-term use and suppression of the heat cycling-induced outmigration of low molecular weight components.

The melting point specified by the maximum endothermic peak during temperature ramp-up measurement with a differential scanning calorimeter (DSC) on these release agents is preferably at least 60° C. and not more than 140° C. and is more preferably at least 65° C. and not more than 120° C. Suppression of toner deterioration during long-term use is readily achieved when the melting point is at least 60° C. A reduction in the low-temperature fixability is inhibited when the melting point is not more than 140° C. The melting point of the release agent is the peak temperature of the maximum endothermic peak measured with a DSC. The measurement is carried out according to ASTM D 3417-99. For example, a DSC-7 from PerkinElmer Inc., a DSC 2920 from TA Instruments, or a Q1000 from TA Instruments can be used. Temperature correction in the instrument detection section uses the melting points of indium and zinc, and the amount of heat is corrected using the heat of fusion of indium. The measurement is run using an aluminum pan for the measurement sample and installing an empty pan for reference.

The colorant will now be described.

Carbon black, a magnetic body, or a black colorant provided by color mixing using the yellow/magenta/cyan colorants described below to give a black color can be used as the black colorant.

A single-component developing system is an effective means for downsizing a printer. Another effective means is to eliminate the feed roller that feeds the toner within the cartridge to the toner-carrying member. A magnetic single-component developing system is preferred for such a feed roller-free single-component developing system, and the colorant for the toner is preferably a magnetic toner that uses a magnetic body. A high transportability and a high tinting strength can be achieved by using such a magnetic toner.

The magnetic body is preferably a magnetic body in which the main component is a magnetic iron oxide such as triiron tetroxide and γ-iron oxide, and it may contain an element such as phosphorus, cobalt, nickel, copper, magnesium, manganese, aluminum and silicon.

The BET specific surface area of the magnetic body by the nitrogen adsorption method is preferably at least 2.0 $m^2/g$ and not more than 20.0 $m^2/g$ and is more preferably at least 3.0 $m^2/g$ and not more than 10.0 $m^2/g$.

The shape of the magnetic body is, for example, polyhedral, octahedral, hexahedral, spherical, acicular, or scale, and a low-anisotropy magnetic body such as polyhedral, octahedral, hexahedral, and spherical is preferred from the standpoint of increasing the image density. Viewed from the standpoint of the tint and a uniform dispersity in the toner, the number-average particle diameter of the magnetic body is preferably at least 0.10 μm and not more than 0.40 μm.

The number-average particle diameter of the magnetic body can be measured using a transmission electron microscope. Specifically, the toner to be observed is thoroughly dispersed in an epoxy resin followed by curing for two days in an atmosphere with a temperature of 40° C. to obtain a cured material. A thin-section sample is prepared from this cured material using a microtome, and the particle diameters of 100 magnetic bodies are measured in the field of observation of a 10,000× to 40,000× photograph using a transmission electron microscope (TEM). The number-average particle diameter is calculated based on the circle-equivalent diameters of the projected areas of the magnetic bodies. The particle diameter can also be measured with an image analyzer.

With regard to the state of the magnetic bodies within the toner particle, preferably magnetic bodies are not exposed at the surface of the toner particle and are present in the interior from the surface. Moreover, the magnetic body content and its state are preferably uniform from toner particle to toner particle. A toner having magnetic bodies in such a dispersed state can be produced, for example, by executing a desired hydrophobic treatment on the magnetic body and carrying out toner production by suspension polymerization.

The magnetic body can be produced, for example, by the following method.

First, an alkali such as sodium hydroxide is added—in an equivalent amount or more than an equivalent amount with reference to the iron component—to an aqueous solution of a ferrous salt to prepare an aqueous solution containing ferrous hydroxide. Air is blown in while keeping the pH of the prepared aqueous solution at 7.0 or above, and an oxidation reaction is carried out on the ferrous hydroxide while heating the aqueous solution to at least 70° C. to produce seed crystals that will form the cores for magnetic iron oxide particles.

Then, an aqueous solution containing ferrous sulfate is added, in an amount that is approximately 1 equivalent based on the amount of addition of the previously added alkali, to the seed crystal-containing slurry. While maintaining the pH of the solution at 5.0 to 10.0 and blowing in air, the reaction of the ferrous hydroxide is developed in order to grow magnetic iron oxide particles using the seed crystals as cores. At this point, the shape and magnetic properties of the magnetic iron oxide can be controlled by free selection of the pH, reaction temperature, and stirring conditions. The pH of the mixture transitions to the acidic side as the oxidation reaction progresses, but the pH of the mixture preferably does not drop below 5.

After the completion of the oxidation reaction, a silicon source such as sodium silicate is added and the pH of the mixture is adjusted to at least 5.0 and not more than 8.0 and a silicon coating layer is formed on the surface of the magnetic iron oxide particles. The obtained magnetic iron oxide particles are filtered, washed, and dried by standard methods to obtain a magnetic iron oxide (magnetic body).

In addition, when the toner base particles are produced in an aqueous medium, e.g., by a suspension polymerization method, a hydrophobic treatment of the magnetic body surface is preferred from the standpoint of facilitating the incorporation of the magnetic bodies within the toner particle. When this hydrophobic treatment is carried out by a dry method, the hydrophobic treatment is carried out using a coupling agent on the washed, filtered, and dried magnetic iron oxide.

When the hydrophobic treatment is carried out by a wet method, treatment with the coupling agent is carried out with redispersion in an aqueous medium of the magnetic iron oxide obtained as above, or with redispersion, in a separate aqueous medium without drying, of the magnetic iron oxide obtained by washing and filtration as described above.

For example, a silane coupling agent or silane compound is added while thoroughly stirring the redispersion and a coupling treatment is carried out by raising the temperature after hydrolysis or by adjusting the pH of the dispersion after hydrolysis into the alkaline region.

The coupling agents and silane compounds that can be used for hydrophobic treatment of the magnetic body can be exemplified by silane coupling agents, titanium coupling agents, and silane compounds. Silane coupling agents or silane compounds given by the following general formula (I) are preferred.

$$R_mSiY_n \qquad \text{formula (I)}$$

[In formula (I), R represents an alkoxy group or hydroxyl group; Y represents an alkyl group, phenyl group, or vinyl group wherein the alkyl group may have an amino group, hydroxy group, epoxy group, acryl group, methacryl group, and so forth as a substituent; m represents an integer from 1 to 3; and n represents an integer from 1 to 3; with the proviso that m+n=4.]

The silane coupling agents and silane compounds given by formula (I) can be exemplified by vinyltrimethoxysilane, vinyltriethoxysilane, vinyltris(β-methoxyethoxy)silane, β-(3,4-epoxycyclohexyl)ethyltrimethoxysilane, γ-glycidoxypropyltrimethoxysilane, γ-glycidoxypropylmethyldiethoxysilane, γ-aminopropyltriethoxysilane, N-phenyl-γ-aminopropyltrimethoxysilane, γ-methacryloxypropyltrimethoxysilane, vinyltriacetoxysilane, methyltrimethoxysilane, dimethyldimethoxysilane, phenyltrimethoxysilane, diphenyldimethoxysilane, methyltriethoxysilane, dimethyldiethoxysilane, phenyltriethoxysilane, diphenyldiethoxysilane, n-propyltrimethoxysilane, isopropyltrimethoxysilane, n-butyltrimethoxysilane, isobutyltrimethoxysilane, trimethylmethoxysilane, n-hexyltrimethoxysilane, n-octyltrimethoxysilane, n-octyltriethoxysilane, n-decyltrimethoxysilane, hydroxypropyltrimethoxysilane, n-hexadecyltrimethoxysilane, and n-octadecyltrimethoxysilane and the hydrolyzates of the preceding.

Y in formula (I) is preferably an alkyl group. Among these, alkyl groups having 3 to 6 carbons are preferred.

In the case of use of a silane coupling agent, treatment may be carried out with a single one or may be carried out using a plurality of species in combination. When the combination of a plurality of species is used, a separate treatment may be performed with each individual silane coupling agent or a simultaneous treatment may be carried out.

The total treatment amount with the coupling agent is preferably 0.9 mass parts to 3.0 mass parts per 100 mass parts of the magnetic body, and the amount thereof should be adjusted in conformity with the surface area of the magnetic body, the reactivity of the silane coupling agent, and so forth.

The other colorant may be used in combination with the magnetic body. As the colorant which is used in combination with the magnetic body, is various pigment, dye, carbon black and so forth can be exemplified.

The magnetic body content in the toner particle, per 100 mass parts of the binder resin, is preferably at least 40 mass parts and not more than 90 mass parts and more preferably at least 50 mass parts and not more than 70 mass parts. At 40 mass parts and above, enhancement of the image density is facilitated due to a high tinting strength. At not more than 90 mass parts, on the other hand, suppression of solid image chipping is facilitated.

The magnetic body content in the toner particle can be measured using a [TGA7] thermal analyzer from PerkinElmer Inc. The measurement method is as follows.

The toner is heated in a nitrogen atmosphere from normal temperature to 900° C. at a ramp rate of 25° C./minute. The mass loss % from 100° C. to 750° C. is taken to be the amount of the binder resin and the remaining mass is taken to be approximately the amount of the magnetic body.

The yellow colorant can be exemplified by compounds as typified by condensed azo compounds, isoindolinone compounds, anthraquinone compounds, azo metal complexes, methine compounds, and allylamide compounds. Specific examples are C. I. Pigment Yellow 12, 13, 14, 15, 17, 62, 73, 74, 83, 93, 94, 95, 97, 109, 110, 111, 120, 128, 129, 138, 147, 150, 151, 154, 155, 168, 180, 185, and 214.

The magenta colorant can be exemplified by condensed azo compounds, diketopyrrolopyrrole compounds, anthraquinone compounds, quinacridone compounds, basic dye lake compounds, naphthol compounds, benzimidazolone compounds, thioindigo compounds, and perylene compounds. Specific examples are C. I. Pigment Red 2, 3, 5, 6, 7, 23, 48:2, 48:3, 48:4, 57:1, 81:1, 122, 146, 166, 169, 177, 184, 185, 202, 206, 220, 221, 238, 254, and 269 and C. I. Pigment Violet 19.

The cyan colorant can be exemplified by copper phthalocyanine compounds and their derivatives, anthraquinone compounds, and basic dye lake compounds. Specific examples are C. I. Pigment Blue 1, 7, 15, 15:1, 15:2, 15:3, 15:4, 60, 62, and 66.

A single one of these colorants may be used or a mixture may be used and these colorants may also be used in a solid solution state. The colorant is selected considering the hue angle, chroma, lightness, lightfastness, OHP transparency, and dispersibility in the toner particle. The colorant content is preferably 1 mass parts to 20 mass parts per 100 mass parts of the polymerizable monomer or binder resin.

The toner base particles can be produced in the present invention by any known method. Production by a pulverization method is described first.

When the toner base particles are produced by a pulverization method, for example, the components of the toner, such as the binder resin, colorant, amorphous polyester, and crystalline polyester, and other additives are thoroughly mixed using a mixer, e.g., Henschel mixer, ball mill, and so forth. The toner base particles can then be obtained by carrying out melt-kneading using a heated kneader such as a hot roll, kneader, or extruder in order to disperse or dissolve the aforementioned materials, followed by cooling and solidification, pulverization, and then classification and as necessary the execution of a surface treatment. With regard to the sequencing of classification and the surface treatment, either may be carried out first. Viewed from the standpoint of the production efficiency, the classification step preferably uses a multi-grade classifier.

While the toner base particles can be produced by a pulverization method as described above, the toner base particles are preferably produced in an aqueous medium—e.g., by a dispersion polymerization method, association aggregation method, dissolution suspension method, suspension polymerization method, and so forth—in order to control, for example, the state of occurrence of the amorphous polyester domains, and the suspension polymerization method is more preferred among the preceding.

In the suspension polymerization method, a polymerizable monomer composition is obtained by dissolving or dispersing the amorphous polyester, the crystalline polyester, the polymerizable monomer that will produce the binder resin, and the colorant (and as necessary a polymerization initiator, crosslinking agent, charge control agent, and other additives). This polymerizable monomer composition is then added to a continuous phase (for example, an aqueous medium (as necessary also containing a dispersion stabilizer)). Particles of the polymerizable monomer composition are formed in the continuous phase (in the aqueous medium), and the polymerizable monomer present in the particles is polymerized to yield toner base particles. The shape of the individual toner particles in the toner yielded by the suspension polymerization method (also referred to below as "polymerized toner") is uniformly approximately spherical and as a result improvement in the flowability at control members is facilitated and triboelectric charging is facilitated, and as a consequence control defects are readily suppressed. Such a toner also takes on a relatively uniform charge quantity distribution, and as a consequence an enhanced image quality can be expected.

The polymerizable monomer can be exemplified by styrene and styrenic monomers such as o-methylstyrene, m-methylstyrene, p-methylstyrene, p-methoxystyrene, and p-ethylstyrene; acrylate esters such as methyl acrylate, ethyl acrylate, n-butyl acrylate, isobutyl acrylate, n-propyl acrylate, n-octyl acrylate, dodecyl acrylate, 2-ethylhexyl acrylate, stearyl acrylate, 2-chloroethyl acrylate, and phenyl acrylate; and methacrylate esters such as methyl methacrylate, ethyl methacrylate, n-propyl methacrylate, n-butyl methacrylate, isobutyl methacrylate, n-octyl methacrylate, dodecyl methacrylate, 2-ethylhexyl methacrylate, stearyl methacrylate, phenyl methacrylate, dimethylaminoethyl methacrylate, and diethylaminoethyl methacrylate. Other examples are acrylonitrile, methacrylonitrile, and acrylamide. These can be used individually or a combination of a plurality can be used.

Advantageous examples among the polymerizable monomers given above are the styrenic monomers, acrylate ester monomers, and methacrylate ester monomers. In particular, the use of a combination of styrene and n-butyl acrylate is more preferred because this facilitates a reduction in the hygroscopicity and facilitates improvement in the transferability in high-temperature, high-humidity environments.

The content of the styrenic monomer in the polymerizable monomer is preferably at least 60 mass % and not more than 90 mass % and is more preferably at least 65 mass % and not more than 85 mass %. On the other hand, the content of acrylate ester monomer or methacrylate ester monomer is preferably at least 10 mass % and not more than 40 mass % and is more preferably at least 15 mass % and not more than 35 mass %.

The polymerizable monomer composition preferably contains a polar resin. Since toner particle production is carried out in an aqueous medium in the suspension polymerization method, the incorporation of a polar resin can result in the presence of the polar resin at the toner particle surface, which facilitates improvements in the charging performance and facilitates suppression of post-black fogging.

The polar resin can be exemplified by homopolymers of styrene and its substituted forms such as polystyrene and polyvinyltoluene; styrene copolymers such as styrene-propylene copolymers, styrene-vinyltoluene copolymers, styrene-vinylnaphthalene copolymers, styrene-methyl acrylate copolymers, styrene-ethyl acrylate copolymers, styrene-butyl acrylate copolymers, styrene-octyl acrylate copolymers, styrene-dimethylaminoethyl acrylate copolymers, styrene-methyl methacrylate copolymers, styrene-ethyl methacrylate copolymers, styrene-butyl methacrylate copolymers, styrene-dimethylaminoethyl methacrylate copolymers, styrene-vinyl methyl ether copolymers, styrene-vinyl ethyl ether copolymers, styrene-vinyl methyl ketone copolymers, styrene-butadiene copolymers, styrene-isoprene copolymers, styrene-maleic acid copolymers, and styrene-maleate ester copolymers; as well as polymethyl methacrylate, polybutyl methacrylate, polyvinyl acetate, polyethylene, polypropylene, polyvinyl butyral, silicone resins, polyamide resins, epoxy resins, polyacrylic acid resins, terpene resins, and phenolic resins. A single one of these may be used or a combination of a plurality may be used. In addition, a functional group, such as amino group, carboxyl group, hydroxyl group, sulfonic acid group, glycidyl group, and nitrile group, may be introduced into these polymers.

The polymerization initiator preferably has a half-life in the polymerization reaction of at least 0.5 hours and not more than 30.0 hours. In addition, a desirable strength and suitable melting characteristics can be imparted to the toner base particles when the polymerization reaction is carried out using an amount of addition of at least 0.5 mass parts and not more than 20.0 mass parts per 100 mass parts of the polymerizable monomer.

Specific examples are as follows: azo and diazo polymerization initiators such as 2,2'-azobis(2,4-dimethylvaleronitrile), 2,2'-azobisisobutyronitrile, 1,1'-azobis(cyclohexane-1-carbonitrile), 2,2'-azobis-4-methoxy-2,4-dimethylvaleronitrile, and azobisisobutyronitrile, and peroxide polymerization initiators such as benzoyl peroxide, methyl ethyl ketone peroxide, diisopropyl peroxycarbonate, cumene hydroperoxide, 2,4-dichlorobenzoyl peroxide, lauroyl peroxide, tert-butyl peroxy-2-ethylhexanoate, and t-butyl peroxypivalate.

A crosslinking agent may be added when the toner base particles are produced by a polymerization method, and a preferred amount of addition for this is at least 0.01 mass parts and not more than 5.00 mass parts per 100 mass parts of the polymerizable monomer. Primarily compounds having at least two polymerizable double bonds are preferred for this crosslinking agent. For example, the following may be used individually or as mixtures of two or more: aromatic divinyl compounds such as divinylbenzene and divinylnaphthalene; carboxylate esters having two double bonds such as, for example, ethylene glycol diacrylate, ethylene glycol dimethacrylate, and 1,3-butanediol dimethacrylate; divinyl compounds such as divinylaniline, divinyl ether, divinyl sulfide, and divinyl sulfone; and compounds having three or more vinyl groups.

In the production of the toner by a polymerization method, as necessary the toner composition and so forth as described above are combined and a polymerizable monomer composition is obtained by carrying out dissolution or dispersion to uniformity using a disperser. The disperser can be exemplified by homogenizers, ball mills, and ultrasound dispersers. The obtained polymerizable monomer composition is suspended in an aqueous medium that contains a dispersion stabilizer. When this is done, the particle diameter for the obtained toner base particles can be made sharper to the degree that the desired toner base particle size can be produced all at once using a high-speed disperser such as a high-speed stirrer or an ultrasound disperser. With regard to the time point for the addition of the polymerization initiator, addition may be carried out at the same time as the addition of the other additives to the polymerizable monomer, or it may be mixed immediately prior to suspension in the aqueous medium. In addition, the polymerization initiator may also be added immediately after granulation and prior to the start of the polymerization reaction.

After granulation, stirring is desirably carried out using a common stirrer to a degree that maintains the particulate state and prevents the flotation or sedimentation of the particles.

Various surfactants, organic dispersing agents, and inorganic dispersing agents can be used as a dispersion stabilizer in the production of the toner. Among these, the use of inorganic dispersing agents is preferred because they resist the production of ultrafine dust and they achieve dispersion stability through steric hindrance. These inorganic dispersing agents can be exemplified by multivalent metal salts of phosphoric acid, such as tricalcium phosphate, magnesium phosphate, aluminum phosphate, zinc phosphate, and hydroxyapatite; carbonates such as calcium carbonate and magnesium carbonate; inorganic salts such as calcium metasilicate, calcium sulfate, and barium sulfate; and inorganic compounds such as calcium hydroxide, magnesium hydroxide, and aluminum hydroxide.

The amount of addition of these inorganic dispersing agents is preferably at least 0.2 mass parts and not more than 20.0 mass parts per 100 mass parts of the polymerizable monomer. In addition, a single one of these dispersion stabilizers may be used by itself or a plurality may be used in combination. Co-use with surfactant may also be carried out.

The polymerization temperature in the step of polymerizing the polymerizable monomer is set generally to at least 40° C. and preferably to at least 50° C. and not more than 90° C.

The following steps are preferably executed in order to bring about the formation of the amorphous polyester domains and bring about the presence of the crystalline polyester component within the domains.

After colored particles have been obtained upon completion of the polymerization of the polymerizable monomer, the dispersion of the colored particles dispersed in the aqueous medium preferably is heated to around the softening point of the amorphous polyester (for example, the softening point of the amorphous polyester to this softening point+10° C.) and specifically to about 100° C. and is held at this temperature for at least 30 minutes.

This holding time is more preferably at least 60 minutes and is even more preferably at least 120 minutes. The upper limit on the holding time is about not more than 24 hours in view of the relationship to the production efficiency.

The dispersion is subsequently preferably cooled to equal to or less than the glass transition temperature (Tg) of the resin particles at a cooling rate of at least 5.0° C./minute and more preferably is cooled at a cooling rate of at least 20° C./minute and even more preferably is cooled at a cooling rate of at least 100° C./minute. The upper limit on this cooling rate is about not more than 500° C./minute in view of the relationship to the production efficiency.

In addition, after cooling at the aforementioned cooling rate, preferably holding is carried out at this temperature for at least 30 minutes. The holding time is more preferably at least 60 minutes and is even more preferably at least 120 minutes. The upper limit on this holding time is about not more than 24 hours in view of the relationship to the production efficiency.

Here, equal to or less than the glass transition temperature (Tg) is preferably from the glass transition temperature (Tg) to the glass transition temperature—about 5° C.

The obtained polymer particles are filtered, washed, and dried to obtain the toner base particles. These toner base particles may be used as such as the toner, or the toner may be obtained optionally by the admixture of inorganic fine particles and the attachment of same to the toner base particle surface. In addition, the coarse particles and fines present in the toner may also be cut out by the introduction of a classification step into the production process (prior to mixing with the inorganic fine particles).

Inorganic fine particles having a number-average primary particle diameter preferably of at least 4 nm and not more than 80 nm and more preferably of at least 6 nm and not more than 40 nm are preferably added (externally added) to the toner base particles as a fluidizing agent. The inorganic fine particles are added in order to improve the flowability of the toner and provide uniform charging of the toner, but in a preferred embodiment functionalities such as adjustment of the charge quantity on the toner, improving the environmental stability, and so forth, are also imparted by subjecting the inorganic fine particles to a treatment such as a hydrophobic treatment.

The method for measuring the number-average primary particle diameter of the inorganic fine particles in the present invention uses photographs of the toner particles enlarged and taken with a scanning electron microscope.

Fine particles of, e.g., silica, titanium oxide, alumina, and so forth, can be used as the inorganic fine particles. The silica fine particles can be exemplified by dry silicas, referred to as so-called dry-method or fumed silica, produced by the vapor-phase oxidation of silicon halide and by so-called wet silica produced from, e.g., water glass.

However, dry silica, which has little silanol group at the surface or in the interior of the silica fine particle and which contains little production residues such as $Na_2O$ and $SO_3^{2-}$, is preferred. In addition, composite fine particles of silica and another metal oxide can also be obtained by the use in the production process of a silicon halide compound in combination with another metal halide compound, for example, aluminum chloride or titanium chloride, and these are also encompassed by dry silica.

The amount of addition of the inorganic fine particles preferably is 0.1 mass parts to 3.0 mass parts per 100 mass parts of the toner base particles. The content of the inorganic fine particles can be quantitated using x-ray fluorescence analysis using a calibration curve constructed from standard samples.

The inorganic fine particles in the present invention are preferably inorganic fine particles that have been subjected to a hydrophobic treatment, because this can bring about improvements in the environmental stability of the toner. The treatment agent used in the hydrophobic treatment of the inorganic fine particles can be exemplified by silicone varnishes, various modified silicone varnishes, silicone oils, various modified silicone oils, silane compounds, and silane coupling agents. Additional examples are treatment agents such as organosilicon compounds other than the preceding, organotitanium compounds, and so forth. A single one of these may be used by itself or a combination of a plurality of species may be used.

Among these treatment agents, treatment with a silicone oil is preferred, while treatment of the inorganic fine particles with a silicone oil after or at the same time as a hydrophobic treatment with a silane compound is more preferred. Such a method for treating inorganic fine particles can be exemplified by carrying out a silylation reaction with the silane compound in a first-stage reaction in order to extinguish the silanol group by chemical bonding and then, in a second-stage reaction, forming a hydrophobic thin film on the surface using the silicone oil.

This silicone oil has a viscosity at 25° C. preferably of at least 10 $mm^2/s$ and not more than 200,000 $mm^2/s$ and more preferably at least 3,000 $mm^2/s$ and not more than 80,000 $mm^2/s$.

Particularly preferred examples of the silicone oil used here are dimethylsilicone oils, methylphenylsilicone oils, α-methylstyrene-modified silicone oils, chlorophenylsilicone oils, and fluorine-modified silicone oils.

The method for treating inorganic fine particles with silicone oil can be exemplified by methods in which the silicone oil is directly mixed with the silane compound-treated inorganic fine particles using a mixer such as a Henschel mixer and methods in which the silicone oil is sprayed on the inorganic fine particles. Or, a method may be used in which the silicone oil is dissolved or dispersed in a suitable solvent; the inorganic fine particles are then added with mixing; and the solvent is removed. Spraying methods are more preferred because they result in relatively little production of aggregates of the inorganic fine particles.

The amount of treatment with the silicone oil, expressed per 100 mass parts of the inorganic fine particles, is preferably 1 mass part to 40 mass parts and is more preferably 3 mass parts to 35 mass parts. An excellent hydrophobicity is readily obtained within this range.

In order to impart an excellent flowability to the toner, the inorganic fine particles used by the present invention have a specific surface area, as measured by the BET method using nitrogen adsorption, preferably within the range of 20 to 350 $m^2/g$ and more preferably 25 to 300 $m^2/g$. The specific surface area is determined by the BET method using a BET multipoint method by adsorption of nitrogen gas on the sample surface using an Autosorb 1 specific surface area measurement instrument (Yuasa Ionics Inc.).

Small amounts of other additives may also be used in the toner of the present invention, for example, lubricant particles such as fluororesin particles, zinc stearate particles, and polyvinylidene fluoride particles; abrasives such as cerium oxide particles, silicon carbide particles, and strontium titanate particles; flowability-imparting agents such as titanium oxide particles and aluminum oxide particles; anti-caking agents; and opposite polarity organic fine particles or inorganic fine particles as developing performance improving agents. These additives may also be used after the execution of a hydrophobic treatment on the surface thereof.

The present invention relates to a developing apparatus that has a toner that develops an electrostatic latent image formed on an image-bearing member, and a toner-carrying member that carries the toner and transports the toner to the image-bearing member.

The present invention further relates to an image-forming apparatus that has an image-bearing member, a charging member that charges the image-bearing member, a toner that develops an electrostatic latent image formed on the image-bearing member, and a toner-carrying member that contacts the image-bearing member and transports the toner, the image-forming apparatus recovering, using the toner-carrying member, toner remaining on the image-bearing member after transfer. A developing apparatus and an image-forming apparatus preferably used by the present invention will be described in detail with reference to the figures.

Figure 2:
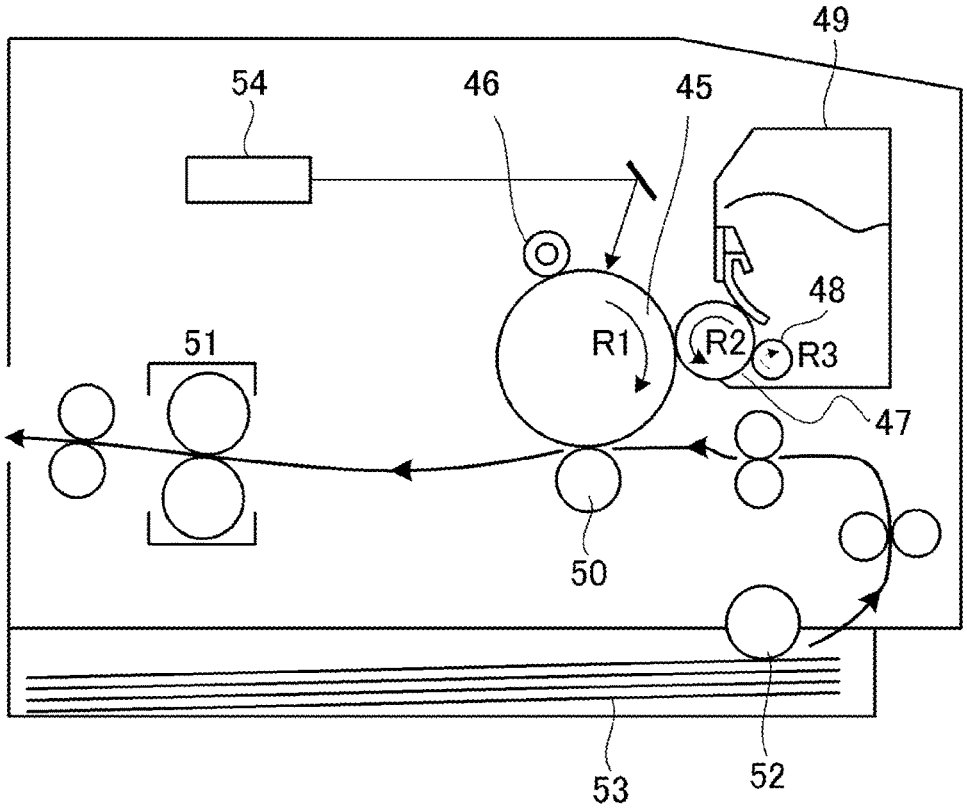
FIG. 2 is a schematic cross-sectional diagram that shows an example of an image-forming apparatus in which a developing apparatus is incorporated.

FIG. 1 is a schematic cross-sectional diagram that shows an example of a developing apparatus. FIG. 2 is a schematic cross-sectional diagram that shows an example of an image-forming apparatus that incorporates a developing apparatus.

In FIG. 1 or FIG. 2, an electrostatic latent image-bearing member 45, which is an image-bearing member on which an electrostatic latent image is formed, is rotated in the direction of the arrow R1. A toner-carrying member 47, through its rotation in the direction of the arrow R2, transports toner 57 into a developing zone where the toner-carrying member 47 and the electrostatic latent image-bearing member 45 are facing each other. In addition, a toner feed member 48 is in contact with the toner-carrying member, and, through its rotation in the direction of the arrow R3, feeds toner 57 to the surface of the toner-carrying member.

The following, inter alia, are disposed on the circumference of the electrostatic latent image-bearing member 45: a charging member (charging roller) 46, a transfer member (transfer roller) 50, a fixing unit 51, and a pick-up roller 52. The electrostatic latent image-bearing member 45 is charged by the charging roller 46. Photoexposure is carried out by irradiating the electrostatic latent image-bearing member 45 with laser light from a laser-generating apparatus 54, thereby forming an electrostatic latent image corresponding to the intended image. The electrostatic latent image on the electrostatic latent image-bearing member 45 is developed by the toner within a developing device 49 to obtain a toner image. The toner image is transferred onto a transfer material (paper) 53 by the transfer member (transfer roller) 50, which is in contact with the electrostatic latent image-bearing member 45 with the transfer material interposed therebetween. The transfer material (paper) 53 carrying the toner image is forwarded to the fixing unit 51 and the toner image is fixed onto the transfer material (paper) 53.

When a cleanerless system is used, a cleaning blade, which is used to remove untransferred toner on the electrostatic latent image-bearing member, is not disposed downstream from the transfer material and upstream from the charging roller, and the toner remaining post-transfer on the electrostatic latent image-bearing member is recovered by the toner-carrying member.

The charging step for the developing apparatus preferably uses a contact charging device whereby the electrostatic latent image-bearing member and the charging roller form an abutting region and are in contact with each other and a prescribed charging bias is applied to the charging roller to charge the surface of the electrostatic latent image-bearing member to a prescribed polarity and potential. The implementation of such a contact charging enables a stable and uniform charging to be carried out and makes it possible to reduce the production of ozone. In order to maintain a uniform contact with the electrostatic latent image-bearing member and carry out uniform charging, the use is more preferred of a charging roller that rotates in the same direction as the electrostatic latent image-bearing member.

Preferably the thickness of the toner layer on the toner-carrying member is controlled through a toner control member 55 that abuts the toner-carrying member with the toner interposed therebetween. A high image quality free of control defects can be obtained by doing this. A control blade is generally used as the toner control member abutting the toner-carrying member, and this can also be suitably used in the present invention.

The developing step is preferably a step in which a toner image is formed by applying a developing bias to the toner-carrying member and thereby transferring the toner to the electrostatic latent image on the electrostatic latent image-bearing member. The applied developing bias may be a direct current voltage or a voltage obtained by superimposing an alternating electric field on a direct current voltage.

A sine wave, rectangular wave, triangular wave, and so forth can be used as appropriate for the waveform of the alternating electric field. This may also be a pulse wave formed by the periodic on/off switching of a direct current power source. A bias such that its voltage value varies periodically can be used as the waveform of such an alternating electric field.

Figure 3:
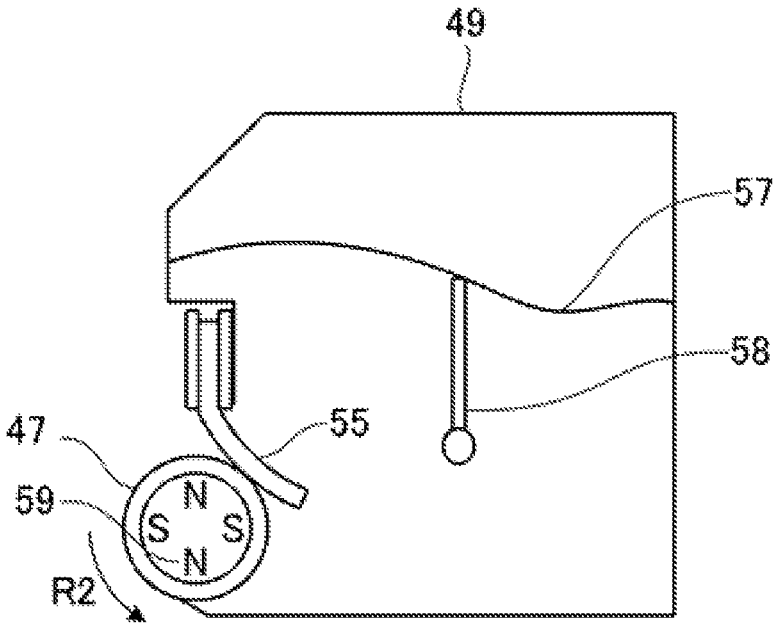
FIG. 3 is a schematic cross-sectional diagram that shows an example of a magnet-containing developing apparatus.

When a method is used in the present invention in which the toner is transported magnetically without using a toner feed member, a magnet may be disposed in the interior of the toner-carrying member (reference number 59 in FIG. 3). In this case, the toner-carrying member preferably has a multipole fixed magnetic in its interior. Preferably 3 to 10 magnetic poles are present.

The methods used to measure the various properties referenced by the present invention are described in the following.

<Method for Measuring the Softening Point of the Toner and the Amorphous Polyester>

Measurement of the softening point of the toner and amorphous polyester is carried out using a "Flowtester CFT-500D Flow Property Evaluation Instrument" (Shimadzu Corporation), which is a constant-load extrusion-type capillary rheometer, according to the manual provided with the instrument. With this instrument, while a constant load is applied by a piston from the top of the measurement sample, the measurement sample filled in a cylinder is heated and melted and the melted measurement sample is extruded from a die at the bottom of the cylinder; a flow curve showing the relationship between piston stroke and temperature is obtained from this.

Figure 4:
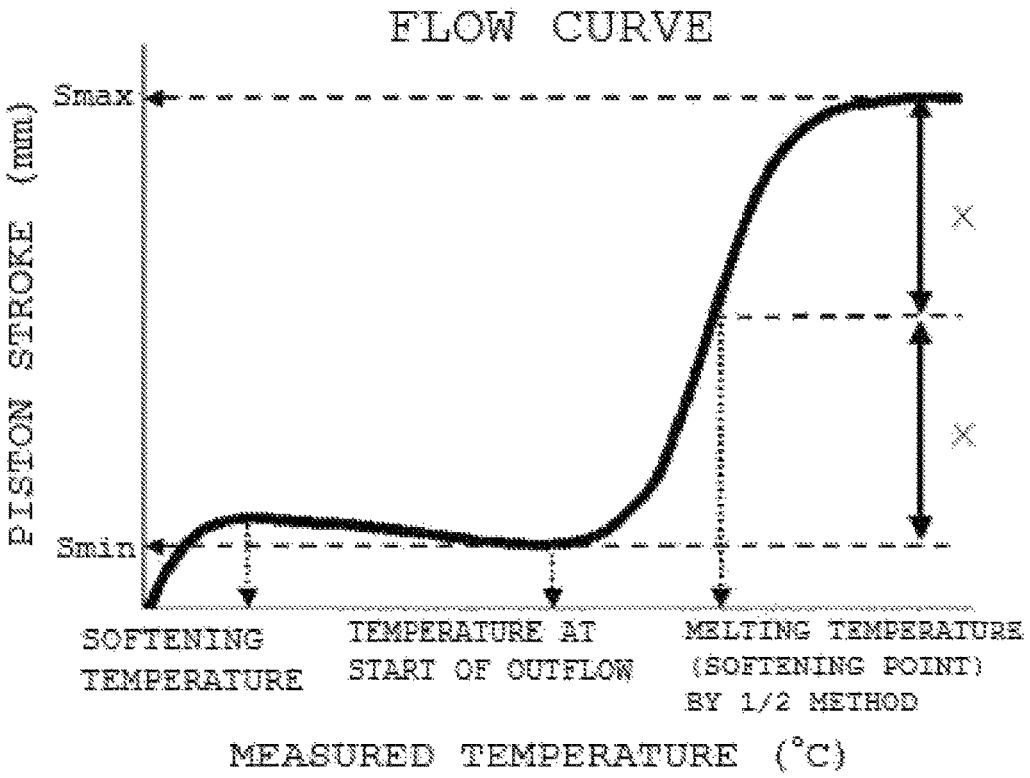
FIG. 4 is a model diagram of a flow curve.

The "melting temperature by the ½ method", as described in the manual provided with the "Flowtester CFT-500D Flow Property Evaluation Instrument", is used as the softening point in the present invention. The melting temperature by the ½ method is determined as follows. First, ½ of the difference between Smax, which is the piston stroke at the completion of outflow, and Smin, which is the piston stroke at the start of outflow, is determined (this value is designated as X, where X=(Smax−Smin)/2). The temperature of the flow curve when the piston stroke in the flow curve reaches the sum of X and Smin is the melting temperature by the ½ method (a model diagram of the flow curve is given in FIG. 4).

The measurement sample used is prepared by subjecting approximately 1.0 g of the toner or amorphous polyester to compression molding for approximately 60 seconds at approximately 10 MPa in a 25° C. environment using a tablet compression molder (for example, NT-100H, NPa System Co., Ltd.) to provide a cylindrical shape with a diameter of approximately 8 mm.

The measurement conditions with the CFT-500D are as follows.

test mode: rising temperature method
start temperature: 50° C.
saturated temperature: 200° C.
measurement interval: 1.0° C.
ramp rate: 4.0° C./min
piston cross section area: 1.000 $cm^2$
test load (piston load): 10.0 kgf (0.9807 MPa)
preheating time: 300 seconds
diameter of die orifice: 1.0 mm
die length: 1.0 mm <Method for Measuring the Weight-Average Particle Diameter (D4)>

Using a "Coulter Counter Multisizer 3" (registered trademark, Beckman Coulter, Inc.), a precision particle size distribution measurement instrument operating on the pore electrical resistance method and equipped with a 100 μm aperture tube, and the accompanying dedicated software, i.e., "Beckman Coulter Multisizer 3 Version 3.51" (Beckman Coulter, Inc.), for setting the measurement conditions and analyzing the measurement data, the weight-average particle diameter (D4) of the toner was determined by performing the measurement in 25,000 channels for the number of effective measurement channels and analyzing the measurement data.

The aqueous electrolyte solution used for the measurements is prepared by dissolving special-grade sodium chloride in deionized water to provide a concentration of approximately 1 mass % and, for example, "ISOTON II" (Beckman Coulter, Inc.) can be used.

The dedicated software was configured as follows prior to measurement and analysis.

In the "modify the standard operating method (SOM)" screen in the dedicated software, the total count number in the control mode is set to 50,000 particles; the number of measurements is set to one time; and the Kd value is set to the value obtained using "standard particle 10.0 μm" (Beckman Coulter, Inc.). The threshold value and noise level are automatically set by pressing the threshold value/noise level measurement button. In addition, the current is set to 1600

μA; the gain is set to 2; the electrolyte is set to ISOTON II; and a check is entered for the post-measurement aperture tube flush.

In the "setting conversion from pulses to particle diameter" screen of the dedicated software, the bin interval is set to logarithmic particle diameter; the particle diameter bin is set to 256 particle diameter bins; and the particle diameter range is set to from 2 μm to 60 μm.

The specific measurement procedure is as follows.

(1) Approximately 200 mL of the above-described aqueous electrolyte solution is introduced into a 250-mL roundbottom glass beaker intended for use with the Multisizer 3 and this is placed in the sample stand and counterclockwise stirring with the stirrer rod is carried out at 24 rotations/second. Contamination and air bubbles within the aperture tube are preliminarily removed by the "aperture flush" function of the dedicated software.

(2) Approximately 30 mL of the above-described aqueous electrolyte solution is introduced into a 100-mL flatbottom glass beaker. To this is added as dispersing agent approximately 0.3 mL of a dilution prepared by the three-fold (mass) dilution with deionized water of "Contaminon N" (a 10 mass % aqueous solution of a neutral pH 7 detergent for cleaning precision measurement instrumentation, comprising a nonionic surfactant, anionic surfactant, and organic builder, Wako Pure Chemical Industries, Ltd.).

(3) A prescribed amount of deionized water is introduced into the water tank of an "Ultrasonic Dispersion System Tetora 150" (Nikkaki Bios Co., Ltd.), which is an ultrasound disperser with an electrical output of 120 W and equipped with two oscillators (oscillation frequency=50 kHz) disposed such that the phases are displaced by 180°, and approximately 2 mL of Contaminon N is added to this water tank.

(4) The beaker described in (2) is set into the beaker holder opening on the ultrasound disperser and the ultrasound disperser is started. The vertical position of the beaker is adjusted in such a manner that the resonance condition of the surface of the aqueous electrolyte solution within the beaker is at a maximum.

(5) While the aqueous electrolyte solution within the beaker set up according to (4) is being irradiated with ultrasound, approximately 10 mg of the toner is added to the aqueous electrolyte solution in small aliquots and dispersion is carried out. The ultrasound dispersion treatment is continued for an additional 60 seconds. The water temperature in the water tank is controlled as appropriate during ultrasound dispersion to be at least 10° C. and not more than 40° C.

(6) Using a pipette, the dispersed toner-containing aqueous electrolyte solution prepared in (5) is dripped into the roundbottom beaker set in the sample stand as described in (1) with adjustment to provide a measurement concentration of approximately 5%. Measurement is then performed until the number of measured particles reaches 50,000.

(7) The measurement data is analyzed by the previously cited dedicated software provided with the instrument and the weight-average particle diameter (D4) is calculated. When set to graph/volume % with the dedicated software, the "average diameter" on the analysis/volumetric statistical value (arithmetic average) screen is the weight-average particle diameter (D4).

<Method for Measuring the Average Circularity of the Toner>

The average circularity of the toner is measured using an "FPIA-3000" (Sysmex Corporation), a flow-type particle image analyzer, and using the measurement and analysis conditions from the calibration process.

The specific measurement method is as follows.

First, approximately 20 mL of deionized water from which solid impurities and so forth have been preliminarily removed, is introduced into a glass container. To this is added as dispersing agent approximately 0.2 mL of a dilution prepared by the approximately three-fold (mass) dilution with deionized water of "Contaminon N" (a 10 mass % aqueous solution of a neutral pH 7 detergent for cleaning precision measurement instrumentation, comprising a nonionic surfactant, anionic surfactant, and organic builder, Wako Pure Chemical Industries, Ltd.). Approximately 0.02 g of the measurement sample is added and a dispersion treatment is carried out for 2 minutes using an ultrasound disperser to provide a dispersion to be used for the measurement. Cooling is carried out as appropriate during this process in order to have the temperature of the dispersion be at least 10° C. and not more than 40° C.

Using a benchtop ultrasound cleaner/disperser that has an oscillation frequency of 50 kHz and an electrical output of 150 W (for example, the "VS-150" (Velvo-Clear Co., Ltd.)) as the ultrasound disperser, a prescribed amount of deionized water is introduced into the water tank and approximately 2 mL of Contaminon N is added to the water tank. The previously cited flow particle image analyzer fitted with a "LUCPLFLN" objective lens (20×, numerical aperture: 0.40) is used for the measurement, and "PSE-900A" (Sysmex Corporation) particle sheath is used for the sheath solution. The dispersion prepared according to the procedure described above is introduced into the flow particle image analyzer and 2,000 of the toner are measured according to total count mode in HPF measurement mode. The average circularity of the toner is determined with the binarization threshold value during particle analysis set at 85% and the analyzed particle diameter limited to a circle-equivalent diameter of at least 1.977 μm and less than 39.54 μm.

For this measurement, automatic focal point adjustment is performed prior to the start of the measurement using reference latex particles (for example, a dilution with deionized water of "RESEARCH AND TEST PARTICLES Latex Microsphere Suspensions 5100A", Duke Scientific). After this, focal point adjustment is preferably performed every two hours after the start of measurement.

In the examples in this application, the flow-type particle image analyzer used had been calibrated by the Sysmex Corporation and had been issued a calibration certificate by the Sysmex Corporation. The measurements were carried out under the same measurement and analysis conditions as when the calibration certification was received, with the exception that the analyzed particle diameter was limited to a circle-equivalent diameter of at least 1.977 μm and less than 39.54 μm.

<Method for Measuring the Peak Molecular Weight Mp(T) for the Toner and the Peak Molecular Weight Mp(P) of the Amorphous Polyester>

The molecular weight distribution of the THF-soluble matter in the toner and amorphous polyester is measured as follows using gel permeation chromatography (GPC).

First, toner is dissolved in tetrahydrofuran (THF) over 24 hours at room temperature. The obtained solution is filtered across a "Sample Pretreatment Cartridge" solvent-resistant membrane filter with a pore diameter of 0.2 μm (Tosoh Corporation) to obtain the sample solution. The sample solution is adjusted to a THF-soluble component concentration of approximately 0.8 mass %. The measurement is performed under the following conditions using this sample solution.

instrument: HLC8120 GPC (detector: RI) (Tosoh Corporation)

columns: 7-column train of Shodex KF-801, 802, 803, 804, 805, 806, and 807 (Showa Denko K.K.)

eluent: tetrahydrofuran (THF)

flow rate: 1.0 mL/minute oven temperature: 40.0° C.

sample injection amount: 0.10 mL

A molecular weight calibration curve constructed using polystyrene resin standards (for example, product name "TSK Standard Polystyrene F-850, F-450, F-288, F-128, F-80, F-40, F-20, F-10, F-4, F-2, F-1, A-5000, A-2500, A-1000, A-500", Tosoh Corporation) is used to determine the molecular weight of the sample.

<Method for Measuring the 25% Area Ratio, the 50% Area Ratio, and the Domain Area Ratio>

(25% Area Ratio)

The toner is thoroughly dispersed in a visible light-curable resin (Aronix LCR Series D-800, Toagosei Co., Ltd.) followed by curing by exposure to short-wavelength light. The resulting cured material is sectioned using an ultramicrotome equipped with a diamond knife to prepare 250-nm thin-section samples. Observation of the toner particle cross section is then carried out using the sectioned samples and a transmission electron microscope (JEM-2800 electron microscope, JEOL Ltd.) (TEM-EDX) at a magnification of 40,000× to 50,000× and element mapping is carried out by EDX.

The toner particle cross sections for observation are selected as follows. First, the cross-sectional area of a toner particle is determined from the toner particle cross-sectional image, and the diameter of the circle having an area equal to this cross-sectional area (the circle-equivalent diameter) is determined. Observation is performed only with toner particle cross-sectional images for which the absolute value of the difference between this circle-equivalent diameter and the weight-average particle diameter (D4) of the toner is within 1.0 μm.

The mapping conditions are a save rate of 9,000 to 13,000 and a number of integrations of 120 times. The spectral intensity originating from the element C in each particular resin-derived domain confirmed from the observed image and the spectral intensity originating from the element O are measured, and the amorphous polyester domains are those domains for which the spectral intensity of the element C with respect to the element O is at least 0.05. After the identification of the amorphous polyester domains, using binarization processing the area ratio (area %)—with respect to the total area of the amorphous polyester domains present in the toner particle cross section—is calculated for the amorphous polyester domains present within 25% of the distance, from the contour of the toner particle cross section, between this contour and the center point of the cross section. Image Pro PLUS (Nippon Roper K.K.) is used for the binarization processing.

The calculation method is as follows. The contour and center point of the toner particle cross section are determined using the aforementioned TEM image. The contour of the toner particle cross section is taken to be the contour along the toner particle surface observed in the TEM image. In addition, the centroid of the toner particle cross section is used for the center point of the toner particle cross section.

A line is drawn from the obtained center point to a point on the contour of the toner particle cross section. The location on this line that is 25%, from the contour, of the distance between the contour and the center point of the cross section is identified.

This operation is carried out on the contour of the toner particle cross section for one time around, thus specifying the boundary line for 25% of the distance, from the contour of the toner particle cross section, between this contour and the center point of the cross section.

Based on this TEM image in which the 25% boundary line has been identified, the area of the amorphous polyester domains present in the region bounded by the toner particle cross section contour and the 25% boundary line is measured. The total area of the amorphous polyester domains present in the toner particle cross section is also measured, and the area % is calculated with reference to this total area.

(50% Area Ratio)

Proceeding as for the measurement of the 25% area ratio described above, the boundary line is identified that is 50% of the distance, from the contour of the toner particle cross section, between the contour and the center point of the cross section. The area of the amorphous polyester domains present in the region bounded by the toner particle cross section contour and the 50% boundary line is measured, and the area % is calculated with reference to the total area of the domains.

(Domain Area Ratio)

Using the calculated values obtained as described above, the following formula is used to obtain the ratio (the domain area ratio) between the area of the amorphous polyester domains present within 25% of the distance, from the contour of the toner particle cross section, between this contour and the center point of the cross section, and the area of the amorphous polyester domains present at 25% to 50% of the distance, from the contour of the toner particle cross section, between this contour and the center point of the cross section.

$$\text{domain area ratio}=(25\%\ \text{area ratio (area \%)})/[(50\%\ \text{area ratio (area \%)})-(25\%\ \text{area ratio (area \%)})]$$

<Method for Measuring the Number-Average Diameter of the Domains Formed by the Amorphous Polyester Component>

The amorphous polyester domains are identified by carrying out element mapping using EDX as described above.

The domain diameter is obtained by determining the circle-equivalent diameter from the domain area. 100 measurements are carried out, and the arithmetic average value of the circle-equivalent diameters of 100 domains is used as the domain diameter.

First, the cross-sectional area of the toner particle is determined from the image of the toner particle cross section, and the diameter of the circle having the same area as this cross-sectional area is determined (circle-equivalent diameter). The domain diameter calculation is carried out only with toner particle cross-sectional images for which the absolute value of the difference between this circle-equivalent diameter and the weight-average particle diameter (D4) (measurement method described above) of the toner is within 1.0 μm. The average domain diameter can be calculated by proceeding in this manner since the domain diameter can fluctuate with the diameter of the toner particle.

<Method for Measuring the Acid Value Av of the Amorphous Polyester and Crystalline Polyester>

The acid value is the number of milligrams of potassium hydroxide required to neutralize the acid present in 1 g of a sample. The acid value of the amorphous polyester and crystalline polyester is measured in accordance with JIS K 0070-1992, and in specific terms it is measured according to the following procedure.

(1) Reagent Preparation

A phenolphthalein solution is obtained by dissolving 1.0 g of phenolphthalein in 90 mL of ethyl alcohol (95 volume %) and bringing to 100 mL by the addition of deionized water.

7 g of special-grade potassium hydroxide is dissolved in 5 mL of deionized water and this is brought to 1 L by the addition of ethyl alcohol (95 volume %). This is introduced into an alkali-resistant container avoiding contact with, for example, carbon dioxide, and allowed to stand for three days, after which time filtration is carried out to obtain a potassium hydroxide solution. The obtained potassium hydroxide solution is stored in an alkali-resistant container. The factor for this potassium hydroxide solution is determined from the amount of the potassium hydroxide solution required for neutralization when 25 mL of 0.1 mol/L hydrochloric acid is introduced into an Erlenmeyer flask, several drops of the aforementioned phenolphthalein solution are added, and titration is performed using the potassium hydroxide solution. The 0.1 mol/L hydrochloric acid used is prepared in accordance with JIS K 8001-1998.

(2) Procedure (A) Main Test 2.0 g of a sample of the pulverized amorphous polyester or crystalline polyester is exactly weighed into a 200-mL Erlenmeyer flask and 100 mL of a toluene/ethanol (2:1) mixed solution is added and dissolution is carried out over 5 hours. Several drops of the aforementioned phenolphthalein solution are added as indicator and titration is performed using the aforementioned potassium hydroxide solution. The titration endpoint is taken to be persistence of the faint pink color of the indicator for approximately 30 seconds.

(B) Blank Test

The same titration as in the above procedure is run, but without using the sample (that is, with only the toluene/ethanol (2:1) mixed solution).

(3) The acid value is calculated by substituting the obtained results into the following formula.

$$A=[(C-B)\times f\times 5.61]/S$$

Here, A: acid value (mg KOH/g); B: amount (mL) of addition of the potassium hydroxide solution in the blank test; C: amount (mL) of addition of the potassium hydroxide solution in the main test; f: factor for the potassium hydroxide solution; and S: sample (g).

<Method for Measuring the Hydroxyl Value OHv of the Amorphous Polyester, Crystalline Polyester, and Long-Chain Monomer>

The hydroxyl value is the number of milligrams of potassium hydroxide required to neutralize the acetic acid bonded with the hydroxyl group when 1 g of the sample is acetylated. The hydroxyl value of the amorphous polyester, crystalline polyester, and long-chain monomer is measured based on JIS K 0070-1992 and in specific terms is measured according to the following procedure.

(1) Reagent Preparation 25 g of special-grade acetic anhydride is introduced into a 100-mL volumetric flask; the total volume is brought to 100 mL by the addition of pyridine; and thorough shaking then provides the acetylation reagent. The obtained acetylation reagent is stored in a brown bottle isolated from contact with, e.g., humidity, carbon dioxide, and so forth.

A phenolphthalein solution is obtained by dissolving 1.0 g of phenolphthalein in 90 mL of ethyl alcohol (95 vol %) and bringing to 100 mL by the addition of deionized water.

35 g of special-grade potassium hydroxide is dissolved in 20 mL of water and this is brought to 1 L by the addition of ethyl alcohol (95 vol %). After standing for three days in an alkali-resistant container isolated from contact with, e.g., carbon dioxide, filtration is performed to obtain a potassium hydroxide solution. The obtained potassium hydroxide solution is stored in an alkali-resistant container. The factor for this potassium hydroxide solution is determined as follows: 25 mL of 0.5 mol/L hydrochloric acid is taken to an Erlenmeyer flask; several drops of the above-described phenolphthalein solution are added; titration is performed with the potassium hydroxide solution; and the factor is determined from the amount of the potassium hydroxide solution required for neutralization. The 0.5 mol/L hydrochloric acid used is prepared in accordance with JIS K 8001-1998.

(2) Procedure (A) Main Test 1.0 g of the pulverized long-chain monomer, amorphous polyester or crystalline polyester is exactly weighed into a 200-mL roundbottom flask and exactly 5.0 mL of the above-described acetylation reactant is added from a whole pipette. When the sample is difficult to dissolve in the acetylation reagent, dissolution is carried out by the addition of a small amount of special-grade toluene.

A small funnel is mounted in the mouth of the flask and heating is then carried out by immersing about 1 cm of the bottom of the flask in a glycerol bath at approximately 97° C. In order at this point to prevent the temperature at the neck of the flask from rising due to the heat from the bath, thick paper in which a round hole has been made is preferably mounted at the base of the neck of the flask.

After 1 hour, the flask is taken off the glycerol bath and allowed to cool. After cooling, the acetic anhydride is hydrolyzed by adding 1 mL of water from the funnel and shaking. In order to accomplish complete hydrolysis, the flask is again heated for 10 minutes on the glycerol bath. After cooling, the funnel and flask walls are washed with 5 mL of ethyl alcohol.

Several drops of the above-described phenolphthalein solution are added as the indicator and titration is performed using the above-described potassium hydroxide solution. The endpoint for the titration is taken to be the point at which the pale pink color of the indicator persists for approximately 30 seconds.

(B) Blank Test

Titration is performed using the same procedure as described above, but without using the amorphous polyester, crystalline polyester, or long-chain monomer sample.

(3) The hydroxyl value is calculated by substituting the obtained results into the following formula.

$$A=[\{(B-C)\times 28.05\times f\}/S]+D$$

Here, A: the hydroxyl value (mg KOH/g); B: the amount of addition (mL) of the potassium hydroxide solution in the blank test; C: the amount of addition (mL) of the potassium hydroxide solution in the main test; f: the factor for the potassium hydroxide solution; S: the sample (g); and D: the acid value (mg KOH/g) of the amorphous polyester, crystalline polyester, or long-chain monomer.

<Method for Measuring the Intensity Ratio (S211/S85) of the Peak Intensity Originating from the Amorphous Polyester (S211) to the Peak Intensity Originating from the Vinyl Resin (S85) by Time-of-Flight Secondary Ion Mass Spectrometry (TOF-SIMS)>

A TRIFT-IV from ULVAC-PHI Incorporated was used for measurement by TOF-SIMS of the intensity ratio (S211/S85) of the peak intensity originating from the amorphous polyester (S211) to the peak intensity originating from the vinyl resin (S85). The analytic conditions were as follows.

sample preparation: toner particle attachment to indium sheet
sample pretreatment: none
primary ion: $Au^+$
acceleration voltage: 30 kV
charge neutralization mode: On
measurement mode: Negative
raster: 100 μm Calculation of the peak intensity (S85) originating from the vinyl resin: the total count number for mass numbers 84.5 to 85.5 according to the standard software (Win Cadense) from ULVAC-PHI Incorporated was used for the peak intensity (S85).

Calculation of the peak intensity (S211) originating from the amorphous polyester: the total count number for mass numbers 210.5 to 211.5 according to the standard software (Win Cadense) from ULVAC-PHI Incorporated was used for the peak intensity (S211).

Calculation of the intensity ratio (S211/S85): the intensity ratio (S211/S85) was calculated using the S85 and S211 calculated as above.

<Measurement of the Peak Value for the Number of Carbons in the Long-Chain Monomer>

The main peak molecular weight of the long-chain monomer is measured as follows using gel permeation chromatography (GPC).

Special-grade 2,6-di-t-butyl-4-methylphenol (BHT) is added to o-dichlorobenzene for gel chromatography to provide a concentration of 0.10 mass % and dissolution at room temperature is carried out. The sample and the BHT-containing o-dichlorobenzene are introduced into a sample bin and heating is carried out on a hot plate set to 150° C. to dissolve the sample. Once the sample has dissolved, this is introduced into a preheated filter unit, which is placed in the main unit. The sample that has passed through the filter unit is the GPC sample.

The sample solution is adjusted to bring the concentration to approximately 0.15 mass %. The measurement is run using this sample solution and the following conditions.

instrument: HLC-8121GPC/HT (Tosoh Corporation)
detector: high-temperature RI
column: 2×TSKgel GMHHR-H HT (Tosoh Corporation)
temperature: 135.0° C.
solvent: o-dichlorobenzene for gel chromatography (0.10 mass % BHT added)
flow rate: 1.0 mL/min
injection amount: 0.4 mL A molecular weight calibration curve constructed using polystyrene resin standards (product name "TSK Standard Polystyrene F-850, F-450, F-288, F-128, F-80, F-40, F-20, F-10, F-4, F-2, F-1, A-5000, A-2500, A-1000, A-500", Tosoh Corporation) is used to determine the main peak molecular weight of the long-chain monomer.

EXAMPLES

The present invention is more specifically described in the following production examples and examples; however, these in no way limit the present invention. Unless specifically indicated otherwise, the number of parts and % in the following blends are on a mass basis in all instances.

(Preparation of Substrate 1)

An SUS304 core with a diameter of 6 mm was coated with a primer (product name: DY35-051, Dow Corning Toray Co., Ltd.) and baked to prepare a substrate 1.

(Fabrication of an Elastic Roller)

The substrate 1 prepared as described above was placed in a mold, and an addition-type silicone rubber composition provided by mixing the following materials was injected into the cavity formed within the mold.

liquid silicone rubber material (product name: SE6724 A/B, Dow Corning Toray Co., Ltd.) 100 parts carbon black (product name: TOKABLACK #4300, Tokai Carbon Co., Ltd.) 15 parts silica particles as an agent for imparting heat resistance 0.2 parts platinum catalyst 0.1 parts The addition-type silicone rubber composition provided by mixing the materials indicated above was injected into the cavity formed in the mold. The mold was then heated and the silicone rubber was cured by vulcanization for 15 minutes at a temperature of 150° C. The substrate having a cured silicone rubber layer at the circumference was demolded from the mold, and the substrate was then heated for an additional 1 hour at a temperature of 180° C. to finish the curing reaction of the silicone rubber layer. Proceeding in this manner, an elastic roller D-1 was fabricated that had an elastic silicone rubber layer with a diameter of 12 mm formed as a coating on the outer circumference of the substrate 1.

(Preparation of Surface Layer)

(Synthesis of Isocyanate Group-Terminated Prepolymer A-1)

100.0 parts of a polypropylene glycol-type polyol (product name: Excenol 4030; Asahi Glass Co., Ltd.) was gradually added dropwise under a nitrogen atmosphere to 17.7 parts of tolylene diisocyanate (TDI) (product name: Cosmonate T80, Mitsui Chemicals, Inc.) in a reaction vessel while maintaining the temperature in the reaction vessel at 65° C. After the completion of the dropwise addition, a reaction was run for 2 hours at a temperature of 65° C. The obtained reaction mixture was cooled to room temperature to obtain an isocyanate group-terminated prepolymer A-1 with an isocyanate group content of 3.8 weight %.

(Synthesis of Amino Compound B-1)

100.0 parts (1.67 mol) of ethylenediamine and 100 parts of pure water were heated to 40° C. while stirring in a reaction vessel fitted with a stirring device, a thermometer, a reflux condenser, a dropwise addition device, and a temperature-regulating apparatus. Then, while maintaining the reaction temperature at not more than 40° C., 425.3 parts (7.35 mol) of propylene oxide was gradually added dropwise over 30 minutes. The reaction was run for an additional 1 hour while stirring to obtain a reaction mixture. The obtained reaction mixture was heated under reduced pressure and the water was distilled off to obtain 426 parts of an amino compound B-1.

<Preparation of Toner-Carrying Member 1>

For the starting material for a surface layer 1, 34.2 parts of the amino compound B-1, 117.4 parts of carbon black (product name: MA230, Mitsubishi Chemical Corporation), and 130.4 parts of urethane resin fine particles (product name: Art-pearl C-400, Negami Chemical Industrial Co., Ltd.) were stirred with and mixed into 617.9 parts of the isocyanate group-terminated prepolymer A-1.

Methyl ethyl ketone (also referred to hereafter as "MEK") was added to provide a total solids fraction ratio of 30 mass % followed by mixing with a sand mill. The viscosity was subsequently adjusted to at least 10 cps and not more than 13 cps using MEK to prepare a surface layer-forming coating.

The previously prepared elastic roller D-1 was immersed in the surface layer-forming coating to form a coating film of this coating on the surface of the elastic layer of the elastic roller D-1 followed by drying. A surface layer having a film thickness of 15 μm was then disposed on the outer circumference of the elastic layer by carrying out a heat treatment for 1 hour at a temperature of 150° C. to produce a toner-carrying member 1.

<Long-Chain Monomer 1 Production Example>

1,200 g of an aliphatic hydrocarbon having a peak value for the number of carbons of 35 was introduced into a cylindrical glass reaction vessel; 38.5 g of boric acid was added at a temperature of 140° C.; a mixed gas of 50 volume % air and 50 volume % nitrogen and having an oxygen concentration of approximately 10 volume % was immediately injected at a rate of 20 liters per minute; a reaction was run for 3.0 hours at 200° C. followed by the addition of hot water to the reaction solution; hydrolysis was performed for 2 hours at 95° C.; and the upper layer reaction product was taken off after standing at quiescence. 20 parts of the modified product was added to 100 parts of n-hexane and the unmodified component was removed by dissolution to obtain a long-chain monomer 1. The properties of the obtained long-chain monomer 1 are given in Table 1.

<Production of Long-Chain Monomers 2 to 4>

Long-chain monomers 2 to 4 were produced proceeding as in the Long-Chain Monomer 1 Production Example, but changing the reaction time and temperature and the peak value for the number of carbons in the aliphatic hydrocarbon used as shown in Table 1.

TABLE 1

| long-chain monomer No. | number of carbons | reaction temperature (° C.) | reaction time (hr) | modification rate (%) | hydroxyl value (mg KOH/g) |
|---|---|---|---|---|---|
| 1 | 35 | 200 | 3 | 93.5 | 92.4 |
| 2 | 25 | 200 | 3 | 91.6 | 90.5 |
| 3 | 102 | 200 | 3 | 89.2 | 88.1 |
| 4 | 35 | 170 | 2.5 | 77.8 | 76.6 |

The number of carbons in the table indicates the peak value for the number of carbons.

<Amorphous Polyester APES1 Production Example>

The starting monomer, with the carboxylic acid component and alcohol component adjusted as shown in Table 2, was introduced into a reaction tank fitted with a nitrogen introduction line, a water separator, a stirrer, and a thermocouple, and 1.5 parts of dibutyltin was added as catalyst per 100 parts of the overall amount of the monomer. Then, after rapidly raising the temperature to 180° C. at normal pressure under a nitrogen atmosphere, a polycondensation was run while distilling off the water while heating from 180° C. to 210° C. at a rate of 10° C./hour. After 210° C. had been reached, the pressure within the reaction tank was reduced to 5 kPa or less, and a polycondensation was run under conditions of 210° C. and 5 kPa or less to obtain an amorphous polyester APES1. The polymerization time was adjusted so as to provide the value in Table 2 for the peak molecular weight of the obtained amorphous polyester APES1. The properties of the amorphous polyester APES1 are given in Table 2.

<Amorphous Polyesters APES2 to APES21 Production Example>

Amorphous polyesters APES2 to APES21 were obtained proceeding as for amorphous polyester APES1, but changing the starting monomers and their use amounts as indicated in Table 2. The properties of these amorphous polyesters are given in Table 2.

TABLE 2

| | | amorphous polyester (APES No.) | | | | | | | | | |
|---|---|---|---|---|---|---|---|---|---|---|---|
| | | 1 | 2 | 3 | 4 | 5 | 6 | 7 | 8 | 9 | 10 |
| starting | [alcohol component] | | | | | | | | | | |
| monomer | bisphenol A-2 mol PO adduct | 90 | 96 | 91 | 91 | 92 | 90 | 90 | 90 | 90 | 100 |
| | long-chain monomer 1 | 10 | 4 | 9 | 9 | 8 | 10 | | | | |
| | long-chain monomer 2 | | | | | | | | 10 | | |
| | long-chain monomer 3 | | | | | | | | | 10 | |
| | long-chain monomer 4 | | | | | | | 10 | | | |
| | [carboxylic acid component] | | | | | | | | | | |
| | terephthalic acid | 74 | 60 | 74 | 76 | 71 | 72 | 74 | 74 | 74 | 68 |
| | trimellitic anhydride | 4 | 3 | 5 | 2 | 7 | 2 | 3 | 3 | 3 | 3 |
| | fumaric acid (C4) | | | | | | | | | | |
| | adipic acid (C6) | 22 | 37 | 21 | 22 | 22 | 26 | 23 | 23 | 23 | 29 |
| | dodecanedioic acid (C12) | | | | | | | | | | |
| molar ratio | carboxylic acid component/ alcohol component | 0.88 | 0.83 | 0.88 | 0.88 | 0.88 | 0.88 | 0.87 | 0.88 | 0.90 | 0.82 |
| peak molecular weight (Mp(P)) | | 10100 | 8600 | 10200 | 9900 | 10200 | 10500 | 9500 | 9700 | 11000 | 9000 |
| softening point | | 95 | 88 | 96 | 94 | 96 | 97 | 93 | 96 | 95 | 92 |
| acid value Av | | 6.0 | 5.0 | 8.5 | 3.0 | 9.5 | 2.0 | 4.0 | 5.0 | 6.5 | 6.5 |
| hydroxyl value Ohv | | 20.0 | 24.0 | 21.0 | 20.0 | 23.0 | 22.0 | 23.0 | 20.0 | 21.0 | 20.0 |

TABLE 2-continued

| | | amorphous polyester (APES No.) | | | | | | | | | | |
|---|---|---|---|---|---|---|---|---|---|---|---|---|
| | | 11 | 12 | 13 | 14 | 15 | 16 | 17 | 18 | 19 | 20 | 21 |
| starting monomer | [alcohol component] | | | | | | | | | | | |
| | bisphenol A-2 mol PO adduct | 94 | 91 | 91 | 90 | 91 | 90 | 90 | 92 | 93 | 100 | 100 |
| | long-chain monomer 1 | 6 | 9 | 9 | 10 | 9 | 10 | 10 | 8 | 7 | | |
| | long-chain monomer 2 | | | | | | | | | | | |
| | long-chain monomer 3 | | | | | | | | | | | |
| | long-chain monomer 4 | | | | | | | | | | | |
| | [carboxylic acid component] | | | | | | | | | | | |
| | terephthalic acid | 59 | 74 | 57 | 78 | 47 | 78 | 84 | 46 | 40 | 72 | 90 |
| | trimellitic anhydride | 3 | 4 | 3 | 4 | 3 | 4 | 5 | 4 | 5 | 8 | 5 |
| | fumaric acid (C4) | | | | | | | | 50 | | 20 | |
| | adipic acid (C6) | 38 | 22 | 40 | 18 | 50 | 18 | | | 55 | | 5 |
| | dodecanedioic acid (C12) | | | | | | | 11 | | | | |
| molar ratio | carboxylic acid component/ alcohol component | 0.83 | 0.92 | 0.81 | 0.93 | 0.80 | 0.94 | 0.93 | 0.82 | 0.80 | 0.86 | 0.83 |
| peak molecular weight (Mp(P)) | | 8500 | 12100 | 8100 | 13000 | 7500 | 13500 | 12900 | 8100 | 7800 | 12100 | 7800 |
| softening point | | 85 | 105 | 82 | 109 | 82 | 115 | 92 | 83 | 81 | 119 | 92 |
| acid value Av | | 7.0 | 5.0 | 6.0 | 5.5 | 6.0 | 6.5 | 5.5 | 6.5 | 6.5 | 15.0 | 7.0 |
| hydroxyl value Ohv | | 21.0 | 23.0 | 20.0 | 21.0 | 20.0 | 24.0 | 22.0 | 20.0 | 21.0 | 23.0 | 21.0 |

The molar ratio in the table represents the molar ratio between the total carboxylic acid component (100 mol %) and the total alcohol component (100 mol %). The long-chain monomer in the table is a molecular chain terminal component.

<Amorphous Polyester APES22 Production Example>

100 g of the 2 mol adduct of ethylene oxide on bisphenol A, 189 g of the 2 mol adduct of propylene oxide on bisphenol A, 51 g of terephthalic acid, 61 g of fumaric acid, 25 g of adipic acid, and 2 g of an esterification catalyst (tin octanoate) were introduced into a four-neck flask equipped with a nitrogen introduction line, a water separator, a stirrer, and a thermocouple. A condensation polymerization reaction was run for 8 hours at 230° C.; the reaction was continued for 1 hour at 8 kPa; cooling was carried out to 160° C. followed by the dropwise addition over 1 hour from a dropping funnel of a mixture of 6 g of acrylic acid, 70 g of styrene, 31 g of n-butyl acrylate, and 20 g of a polymerization initiator (di-t-butyl peroxide); holding was carried out without alteration at 160° C. after the dropwise addition and the addition polymerization reaction was continued for 1 hour; the temperature was then raised to 200° C. and holding was carried out for 1 hour at 10 kPa; and the unreacted acrylic acid, styrene, and butyl acrylate were subsequently removed to obtain an amorphous polyester APES22, which was a composite resin in which a vinyl polymer segment was bonded with a polyester polymer segment.

<Crystalline Polyester CPES1 Production Example>

The monomers in the use amounts shown in Table 3 were introduced into a reaction tank fitted with a nitrogen introduction line, a water separator, a stirrer, and a thermocouple; 1 part of tin dioctanoate was then added as catalyst per 100 parts of the total amount of monomer; and heating was carried out to 140° C. under a nitrogen atmosphere and a reaction was run for 6 hours while distilling out the water under normal pressure. The reaction was then run while raising the temperature to 200° C. at 10° C./hour; the reaction was run for 2 hours after reaching 200° C.; and the pressure within the reaction tank was then reduced to 5 kPa or less and the reaction was run for 3 hours at 200° C. to obtain a crystalline polyester C1. The properties are given in Table 3.

<Production Example for Crystalline Polyesters CPES2 to CPES6>

Crystalline polyesters CPES2 to CPES6 were obtained proceeding as for crystalline polyester CPES1, but changing the monomer as indicated in Table 3. The properties are given in Table 3.

TABLE 3

| | monomer composition | | | | | | weight-average | | |
|---|---|---|---|---|---|---|---|---|---|
| crystalline polyester | alcohol component | molar ratio | acid component 1 | molar ratio | crystal nucleating agent | molar ratio | molecular weight (Mw) | acid value | hydroxyl value |
| CPES1 | 1,9-nonanediol | 100.0 | decanedioic acid (sebacic acid) | 100.0 | stearic acid | 4.0 | 21200 | 2.0 | 5.0 |
| CPES2 | 1,12-dodecanediol | 100.0 | hexanedioic acid | 100.0 | stearic acid | 4.0 | 21100 | 2.0 | 6.0 |
| CPES3 | 1,9-nonanediol | 100.0 | decanedioic acid (sebacic acid) | 100.0 | lauric acid | 4.0 | 20300 | 2.5 | 4.0 |

TABLE 3-continued

| crystalline polyester | monomer composition: alcohol component | molar ratio | acid component 1 | molar ratio | crystal nucleating agent | molar ratio | weight-average molecular weight (Mw) | acid value | hydroxyl value |
|---|---|---|---|---|---|---|---|---|---|
| CPES4 | 1,9-nonanediol | 100.0 | decanedioic acid (sebacic acid) | 100.0 | behenic acid | 4.0 | 22300 | 2.0 | 6.0 |
| CRES5 | 1,9-nonanediol | 100.0 | decanedioic acid (sebacic acid) | 100.0 | none | — | 7800 | 3.0 | 21.0 |
| CPES6 | 1,6-hexanediol | 100.0 | dodecanedioic acid | 100.0 | none | — | 10200 | 5.0 | 20.0 |

<Treated Magnetic Body Production Example>

The following were mixed into an aqueous ferrous sulfate solution to produce an aqueous solution containing ferrous hydroxide: a sodium hydroxide solution at 1.00 to 1.10 equivalents with reference to the element iron, $P_2O_5$ in an amount that provided 0.15 mass % as the element phosphorus with reference to the element iron, and $SiO_2$ in an amount that provided 0.50 mass % as the element silicon with reference to the element iron. The pH of the aqueous solution was brought to 8.0 and an oxidation reaction was run at 85° C. while blowing in air to prepare a slurry that contained seed crystals.

An aqueous ferrous sulfate solution was then added to this slurry so as to provide 0.90 to 1.20 equivalents with reference to the initial amount of the alkali (sodium component in the sodium hydroxide), after which the oxidation reaction was developed while blowing in air and holding the pH of the slurry at 7.6 to obtain a slurry containing magnetic iron oxide. After filtration and washing, this water-containing slurry was temporarily taken out. At this point, a small amount of a water-containing slurry was collected and the water content was measured. Then, without drying, the water-containing slurry was introduced into a separate aqueous medium and redispersion was performed with a pin mill while circulating and stirring the slurry and the pH of the redispersion was adjusted to approximately 4.8. While stirring, an n-hexyltrimethoxysilane coupling agent was added at 1.6 parts per 100 parts of the magnetic iron oxide (the amount of the magnetic iron oxide was calculated as the value provided by subtracting the water content from the water-containing sample) and hydrolysis was carried out. This was followed by thorough stirring and bringing the pH of the dispersion to 8.6 and the execution of a surface treatment. The produced hydrophobic magnetic body was filtered on a filter press and washed with a large amount of water, followed by drying for 15 minutes at 100° C. and 30 minutes at 90° C. and grinding of the resulting particles to obtain a treated magnetic body having a volume-average particle diameter of 0.21 μm.

<Toner Base Particle 1 Production Example>

450 parts of a 0.1 mol/L aqueous $Na_3PO_4$ solution was introduced into 720 parts of deionized water; heating to 60° C. was carried out; and 67.7 parts of a 1.0 mol/L aqueous $CaCl_2$ solution was added to obtain an aqueous medium containing a dispersion stabilizer.

| | |
|---|---|
| styrene | 75.0 parts |
| n-butyl acrylate | 25.0 parts |
| amorphous polyester APES1 | 15.0 parts |
| divinylbenzene | 0.6 parts |
| iron complex of monoazo dye (T-77, Hodogaya Chemical Co., Ltd.) | 1.5 parts |
| treated magnetic body | 65.0 parts |

Using an attritor (Mitsui Miike Chemical Engineering Machinery Co., Ltd.), this formulation was dispersed and mixed to uniformity to obtain a monomer composition. This monomer composition was heated to 63° C. and to this was added 5.0 parts of the crystalline polyester CPES1 and 15 parts of paraffin wax (melting point=78° C.) with mixing and dissolution. This was followed by the dissolution of 5.0 parts of the polymerization initiator tert-butyl peroxypivalate.

The monomer composition described above was introduced into this aqueous medium and granulation was performed by stirring at 60° C. under an $N_2$ atmosphere for 10 minutes at 12,000 rpm using a TK Homomixer (Tokushu Kika Kogyo Co., Ltd.). This was followed by reaction for 4 hours at 70° C. while stirring with a paddle stirring blade. After the completion of the reaction, it was confirmed that colored particles were dispersed in the resulting aqueous medium and that calcium phosphate was attached as an inorganic dispersing agent to the colored particle surface.

At this point, hydrochloric acid was added to the aqueous medium and the calcium phosphate was washed off and removed followed by filtration and drying and analysis of the colored particles. According to the results, the glass transition temperature Tg of the binder resin was 55° C.

The aqueous medium containing the dispersed colored particles was then heated to 100° C. and was held for 120 minutes. This was followed by the introduction of 5° C. water into the aqueous medium to effect cooling from 100° C. to 50° C. at a cooling rate of 100° C./minute. The aqueous medium was then held for 120 minutes at 50° C.

Hydrochloric acid was subsequently added to the aqueous medium and the calcium phosphate was washed off and removed followed by filtration and drying to obtain a toner base particle 1. The production conditions for toner base particle 1 are given in Table 4.

<Production Example for Toner Base Particles 2 to 30, Toner Base Particle 32, and Comparative Toner Base Particles 1 to 3>

Toner base particles 2 to 30, toner base particle 32, and comparative toner base particles 1 to 3 were produced as in the production of toner base particle 1, but changing the amorphous polyester, colorant, and production conditions. The production conditions for the obtained toner base particles and comparative toner base particles are given in Table 4.

<Toner Base Particle 31 Production Example>

<<Preparation of Individual Dispersions>>

—Resin Particle Dispersion (1)— styrene (Wako Pure Chemical Industries, Ltd.): 325 parts n-butyl acrylate (Wako Pure Chemical Industries, Ltd.): 100 parts acrylic acid (Rhodia Nicca, Ltd.): 13 parts 1,10-decanediol diacrylate (Shin-Nakamura Chemical Co., Ltd.): 1.5 parts dodecanethiol (Wako Pure Chemical Industries, Ltd.): 3.0 parts These components were preliminarily mixed and dissolved to prepare a solution; a surfactant solution prepared by the dissolution of 9 parts of an anionic surfactant (Dowfax A211, The Dow Chemical Company) in 580 parts of deionized water was placed in a flask; 400 parts of the aforementioned solution was introduced with dispersion and emulsification; and 6 parts of ammonium persulfate dissolved in 50 parts of deionized water was introduced while gently stirring and mixing for 10 minutes.

The interior of the flask was then thoroughly substituted with nitrogen, after which the interior of the flask was heated on an oil bath to 75° C. while the flask was being stirred. Emulsion polymerization was continued in this state for 5 hours to obtain a resin particle dispersion (1).

When resin particles were separated from the resin particle dispersion (1) and their properties were checked, the number-average particle diameter was 195 nm; the amount of the solids fraction in the dispersion was 42%; the glass transition temperature was 51.5° C.; and the weight-average molecular weight Mw was 32,000.

—Resin Particle Dispersion (2)—

Using a disperser provided by modifying a Cavitron CD1010 (EuroTec, Ltd.) for high temperature and high pressure operation, an amorphous polyester as described above (APES1) was dispersed. Specifically, for a composition of 79% deionized water, 1% (as the effective component) of an anionic surfactant (Neogen RK, DKS Co. Ltd.), and an amorphous polyester (APES1) concentration of 20%, the pH was adjusted to 8.5 with ammonia and a resin fine particle dispersion (2) having a number-average particle diameter of 450 nm was obtained by operating the Cavitron using conditions of a rotor rotation rate of 60 Hz, a pressure of 5 kg/cm$^2$, and 140° C. with heating using a heat exchanger.

—Resin Particle Dispersion (3)—

Using a disperser provided by modifying a Cavitron CD1010 (EuroTec, Ltd.) for high temperature and high pressure operation, a crystalline polyester as described above (CPES1) was dispersed. Specifically, for a composition of 79% deionized water, 1% (as the effective component) of an anionic surfactant (Neogen RK, DKS Co. Ltd.), and a crystalline polyester (CPES1) concentration of 20%, the pH was adjusted to 8.5 with ammonia and a resin fine particle dispersion (3) having a number-average particle diameter of 100 nm was obtained by operating the Cavitron using conditions of a rotor rotation rate of 60 Hz, a pressure of 5 kg/cm$^2$, and 140° C. with heating using a heat exchanger.

—Colorant Dispersion—

| | |
|---|---|
| carbon black | 20 parts |
| anionic surfactant (Neogen R, DKS Co. Ltd.) | 2 parts |
| deionized water | 78 parts |

Using a homogenizer (Ultra-Turrax T50, IKA-Werke GmbH & Co. KG) on these components, the pigment was mixed in the water for 2 minutes at 3,000 rpm and was then dispersed for 10 minutes at 5,000 rpm. Defoaming was subsequently carried out by stirring for 24 hours with a common stirrer, followed by dispersion for approximately 1 hour at a pressure of 240 MPa using an Altimizer (HJP30006, Sugino Machine Limited) high-pressure impact-type disperser to obtain a colorant dispersion (1). The pH of this dispersion was also adjusted to 6.5.

—Release Agent Dispersion—

| | |
|---|---|
| hydrocarbon wax (Fischer-Tropsch wax, maximum endothermic peak = 78° C., Mw = 750) | 45 parts |
| anionic surfactant (Neogen RK, DKS Co. Ltd.) | 5 parts |
| deionized water | 200 parts |

These components were heated to 95° C. and were thoroughly dispersed using a homogenizer (Ultra-Turrax T50, IKA-Werke GmbH & Co. KG) and were then subjected to dispersion processing using a Gaulin pressure ejection homogenizer to obtain a release agent dispersion having a solids fraction of 25% and a number-average diameter of 190 nm.

<<Toner Base Particle Production Example>>

| | |
|---|---|
| deionized water | 400 parts |
| resin particle dispersion (1) (resin particle concentration: 42%) | 620 parts |
| resin particle dispersion (2) (resin particle concentration: 20%) | 209 parts |
| resin particle dispersion (3) (resin particle concentration: 20%) | 70 parts |
| anionic surfactant (Neogen RK, effective component amount: 60%, DKS Co. Ltd.) | 1.5 parts (0.9 parts as the effective component) |

These components were introduced into a 3-L reaction vessel fitted with a thermometer, pH meter, and stirrer and were held for 30 minutes at a stirring rotation rate of 150 rpm and a temperature of 30° C. while controlling the temperature from the outside using a mantle heater. After this, 88 parts of the colorant dispersion and 60 parts of the release agent dispersion were introduced and holding was carried out for 5 minutes. In this same condition, a 1.0% aqueous nitric acid solution was added to adjust the pH to 3.0. The stirrer and mantle heater were then removed; ½ of a mixed solution of 0.33 parts of polyaluminum chloride and 37.5 parts of a 0.1% aqueous nitric acid solution was added while dispersing at 3,000 rpm using a homogenizer (Ultra-Turrax T50, IKA Japan); the dispersion rotation rate was then brought to 5,000 rpm and the remaining ½ was added over 1 minute; and the dispersion rotation rate was brought to 6,500 rpm and dispersion was carried out for 6 minutes.

A stirrer and mantle heater were installed on the reaction vessel and, while adjusting the rotation rate of the stirrer as appropriate to provide thorough stirring of the slurry, the temperature was raised to 42° C. at 0.5° C./minute and holding was carried out for 15 minutes at 42° C. After this, while raising the temperature at 0.05° C./minute, the particle diameter was measured every 10 minutes using a Coulter Multisizer, and, when the weight-average particle diameter became 8.1 μm, the pH was brought to 9.0 using a 5% aqueous sodium hydroxide solution. Then, while adjusting the pH to 9.0 every 5° C., the temperature was raised to 96° C. at a ramp rate of 1° C./minute and holding was carried out at 96° C. for 120 minutes. 5° C. water was subsequently introduced into the aqueous medium to effect cooling from 100° C. to 50° C. at a cooling rate of 100° C./minute. The aqueous medium was then held for 120 minutes at 50° C. This was followed by cooling to 20° C. at 1° C./minute to solidify the particles.

The reaction product was then filtered and washed with deionized water by throughflow until the conductivity of the filtrate was not more than 50 mS; the particles, which had assumed the form of a cake, were taken out and were introduced into deionized water in an amount that was 10-fold that of the weight of the particles; the particles were thoroughly deaggregated by stirring with a Three-One motor; the pH was adjusted to 3.8 with a 1.0% aqueous nitric acid solution; and holding was carried out for 10 minutes. This was followed by another filtration and washing by water throughflow, and, when the conductivity of the filtrate reached 10 mS or less, water throughflow was stopped and solid-liquid separation was performed. The resulting particles, which had assumed the form of a cake, were ground with a sample mill and dried for 24 hours in a 40° C. oven. The obtained powder was ground with a sample mill and was then subjected to an additional vacuum drying for 5 hours in a 40° C. oven to obtain a toner base particle 31.

<Comparative Toner Base Particle 4 Production Example>

<<Preparation of Individual Dispersions>>

—Resin Particle Dispersion (4)—

Using a disperser provided by modifying a Cavitron CD1010 (EuroTec, Ltd.) for high temperature and high pressure operation, an amorphous polyester as described above (APES21) was dispersed. Specifically, for a composition of 79% deionized water, 1% (as the effective component) of an anionic surfactant (Neogen RK, DKS Co. Ltd.), and an amorphous polyester (APES21) concentration of 20%, the pH was adjusted to 8.5 with ammonia and a resin fine particle dispersion (4) having a number-average particle diameter of 450 nm was obtained by operating the Cavitron using conditions of a rotor rotation rate of 60 Hz, a pressure of 5 kg/cm$^2$, and 140° C. with heating using a heat exchanger.

—Resin Particle Dispersion (5)—

Using a disperser provided by modifying a Cavitron CD1010 (EuroTec, Ltd.) for high temperature and high pressure operation, a crystalline polyester as described above (CPES6) was dispersed. Specifically, for a composition of 79% deionized water, 1% (as the effective component) of an anionic surfactant (Neogen RK, DKS Co. Ltd.), and a crystalline polyester (CPES6) concentration of 20%, the pH was adjusted to 8.5 with ammonia and a resin fine particle dispersion (5) having a number-average particle diameter of 110 nm was obtained by operating the Cavitron using conditions of a rotor rotation rate of 60 Hz, a pressure of 5 kg/cm$^2$, and 140° C. with heating using a heat exchanger.

<<Toner Base Particle Production Example>>

| | |
|---|---|
| deionized water | 400 parts |
| resin particle dispersion (1) (resin particle concentration: 42%) | 620 parts |
| resin particle dispersion (4) (resin particle concentration: 20%) | 209 parts |
| resin particle dispersion (5) (resin particle concentration: 20%) | 70 parts |
| anionic surfactant (Neogen RK, effective component amount: 60%, DKS Co. Ltd.) | 1.5 parts (0.9 parts as the effective component) |

These components were introduced into a 3-L reaction vessel fitted with a thermometer, pH meter, and stirrer and were held for 30 minutes at a stirring rotation rate of 150 rpm and a temperature of 30° C. while controlling the temperature from the outside using a mantle heater. After this, 88 parts of the colorant dispersion and 60 parts of the release agent dispersion were introduced and holding was carried out for 5 minutes. In this same condition, a 1.0% aqueous nitric acid solution was added to adjust the pH to 3.0. The stirrer and mantle heater were then removed; ½ of a mixed solution of 0.33 parts of polyaluminum chloride and 37.5 parts of a 0.1% aqueous nitric acid solution was added while dispersing at 3,000 rpm using a homogenizer (Ultra-Turrax T50, IKA Japan); the dispersion rotation rate was then brought to 5,000 rpm and the remaining ½ was added over 1 minute; and the dispersion rotation rate was brought to 6,500 rpm and dispersion was carried out for 6 minutes.

A stirrer and mantle heater were installed on the reaction vessel and, while adjusting the rotation rate of the stirrer as appropriate to provide thorough stirring of the slurry, the temperature was raised to 42° C. at 0.5° C./minute and holding was carried out for 15 minutes at 42° C. After this, while raising the temperature at 0.05° C./minute, the particle diameter was measured every 10 minutes using a Coulter Multisizer, and, when the weight-average particle diameter became 8.2 μm, the pH was brought to 9.0 using a 5% aqueous sodium hydroxide solution. Then, while adjusting the pH to 9.0 every 5° C., the temperature was raised to 96° C. at a ramp rate of 1° C./minute and holding was carried out for 120 minutes. 5° C. water was subsequently introduced into the aqueous medium to effect cooling from 100° C. to 50° C. at a cooling rate of 100° C./minute. The aqueous medium was then held for 120 minutes at 50° C. This was followed by cooling to 20° C. at 1° C./minute to solidify the particles.

The reaction product was then filtered and washed with deionized water by throughflow until the conductivity of the filtrate was not more than 50 mS; the particles, which had assumed the form of a cake, were taken out and were introduced into deionized water in an amount that was 10-fold that of the weight of the particles; the particles were thoroughly deaggregated by stirring with a Three-One motor; the pH was adjusted to 3.8 with a 1.0% aqueous nitric acid solution; and holding was carried out for 10 minutes. This was followed by another filtration and washing by water throughflow, and, when the conductivity of the filtrate reached 10 mS or less, water throughflow was stopped and solid-liquid separation was performed. The resulting particles, which had assumed the form of a cake, were ground with a sample mill and dried for 24 hours in a 40° C. oven. The obtained powder was ground with a sample mill and was then subjected to an additional vacuum drying for 5 hours in a 40° C. oven to obtain a comparative toner base particle 4.

<Comparative Toner Base Particle 5 Production Example>

<<Preparation of Individual Dispersions>>

—Resin Particle Dispersion (6)—

Using a disperser provided by modifying a Cavitron CD1010 (EuroTec, Ltd.) for high temperature and high pressure operation, an amorphous polyester as described above (APES22) was dispersed. Specifically, for a composition of 79% deionized water, 1% (as the effective component) of an anionic surfactant (Neogen RK, DKS Co. Ltd.), and an amorphous polyester (APES22) concentration of 20%, the pH was adjusted to 8.5 with ammonia and a resin fine particle dispersion (6) having a number-average particle diameter of 200 nm was obtained by operating the Cavitron using conditions of a rotor rotation rate of 60 Hz, a pressure of 5 kg/cm$^2$, and 140° C. with heating using a heat exchanger.

<<Toner Base Particle Production Example>>

| | |
|---|---|
| deionized water | 400 parts |
| resin particle dispersion (1) (resin particle concentration: 42%) | 620 parts |
| resin particle dispersion (6) (resin particle concentration: 20%) | 279 parts |
| anionic surfactant (Neogen RK, effective component amount: 60%, DKS Co. Ltd.) | 1.5 parts (0.9 parts as the effective component) |

These components were introduced into a 3-L reaction vessel fitted with a thermometer, pH meter, and stirrer and were held for 30 minutes at a stirring rotation rate of 150 rpm and a temperature of 30° C. while controlling the temperature from the outside using a mantle heater. After this, 88 parts of the colorant dispersion and 60 parts of the release agent dispersion were introduced and holding was carried out for 5 minutes. In this same condition, a 1.0% aqueous nitric acid solution was added to adjust the pH to 3.0. The stirrer and mantle heater were then removed; ½ of a mixed solution of 0.33 parts of polyaluminum chloride and 37.5 parts of a 0.1% aqueous nitric acid solution was added while dispersing at 3,000 rpm using a homogenizer (Ultra-Turrax T50, IKA Japan); the dispersion rotation rate was then brought to 5,000 rpm and the remaining ½ was added over 1 minute; and the dispersion rotation rate was brought to 6,500 rpm and dispersion was carried out for 6 minutes.

A stirrer and mantle heater were installed on the reaction vessel and, while adjusting the rotation rate of the stirrer as appropriate to provide thorough stirring of the slurry, the temperature was raised to 42° C. at 0.5° C./minute and holding was carried out for 15 minutes at 42° C. After this, while raising the temperature at 0.05° C./minute, the particle diameter was measured every 10 minutes using a Coulter Multisizer, and, when the weight-average particle diameter became 8.2 μm, the pH was brought to 9.0 using a 5% aqueous sodium hydroxide solution. Then, while adjusting the pH to 9.0 every 5° C., the temperature was raised to 96° C. at a ramp rate of 1° C./minute. This was followed by cooling to 20° C. at 1° C./minute to solidify the particles.

The reaction product was then filtered and washed with deionized water by throughflow until the conductivity of the filtrate was not more than 50 mS; the particles, which had assumed the form of a cake, were taken out and were introduced into deionized water in an amount that was 10-fold that of the weight of the particles; the particles were thoroughly deaggregated by stirring with a Three-One motor; the pH was adjusted to 3.8 with a 1.0% aqueous nitric acid solution; and holding was carried out for 10 minutes. This was followed by another filtration and washing by water throughflow, and, when the conductivity of the filtrate reached 10 mS or less, water throughflow was stopped and solid-liquid separation was performed. The resulting particles, which had assumed the form of a cake, were ground with a sample mill and dried for 24 hours in a 40° C. oven. The obtained powder was ground with a sample mill and was then subjected to an additional vacuum drying for 5 hours in a 40° C. oven to obtain a comparative toner base particle 5.

TABLE 4

| | amorphous polyester | | crystalline polyester | | colorant | | | | |
|---|---|---|---|---|---|---|---|---|---|
| toner base particle No. | No. | amount of addition [parts] | No. | amount of addition [parts] | type | amount of addition [parts] | holding time at 100° C. [minutes] | cooling rate [° C./minute] | holding time at 50° C. [minutes] |
| 1 | APES 1 | 15.0 | CPES 1 | 5.0 | treated magnetic body | 65.0 | 120 | 100 | 120 |
| 2 | APES 1 | 15.0 | CPES 2 | 5.0 | treated magnetic body | 65.0 | 120 | 100 | 120 |
| 3 | APES 1 | 15.0 | CPES 1 | 5.0 | treated magnetic body | 65.0 | 120 | 5 | 120 |
| 4 | APES 2 | 15.0 | CPES 1 | 5.0 | treated magnetic body | 65.0 | 120 | 100 | 120 |
| 5 | APES 3 | 15.0 | CPES 1 | 5.0 | treated magnetic body | 65.0 | 120 | 100 | 120 |
| 6 | APES 4 | 15.0 | CPES 1 | 5.0 | treated magnetic body | 65.0 | 120 | 100 | 120 |
| 7 | APES 5 | 15.0 | CPES 1 | 5.0 | treated magnetic body | 65.0 | 120 | 100 | 120 |
| 8 | APES 6 | 15.0 | CPES 1 | 5.0 | treated magnetic body | 65.0 | 120 | 100 | 120 |
| 9 | APES 1 | 15.0 | CPES 1 | 15.0 | treated magnetic body | 65.0 | 120 | 100 | 120 |
| 10 | APES 1 | 15.0 | CPES 1 | 3.0 | treated magnetic body | 65.0 | 60 | 100 | 120 |
| 11 | APES 1 | 15.0 | CPES 1 | 18.0 | treated magnetic body | 65.0 | 30 | 100 | 120 |
| 12 | APES 1 | 15.0 | CPES 1 | 2.0 | treated magnetic body | 65.0 | 120 | 100 | 120 |
| 13 | APES 1 | 15.0 | CPES 3 | 5.0 | treated magnetic body | 65.0 | 120 | 100 | 120 |
| 14 | APES 1 | 15.0 | CPES 4 | 5.0 | treated magnetic body | 65.0 | 30 | 100 | 120 |
| 15 | APES 1 | 5.0 | CPES 1 | 3.0 | treated magnetic body | 65.0 | 30 | 100 | 120 |
| 16 | APES 1 | 30.0 | CPES 1 | 5.0 | treated magnetic body | 65.0 | 120 | 100 | 120 |
| 17 | APES 1 | 3.0 | CPES 1 | 2.0 | treated magnetic body | 65.0 | 120 | 100 | 120 |
| 18 | APES 1 | 35.0 | CPES 1 | 5.0 | treated magnetic body | 65.0 | 120 | 5 | 120 |
| 19 | APES 7 | 15.0 | CPES 1 | 5.0 | treated magnetic body | 65.0 | 120 | 100 | 120 |
| 20 | APES 8 | 15.0 | CPES 1 | 5.0 | treated magnetic body | 65.0 | 120 | 100 | 120 |
| 21 | APES 9 | 15.0 | CPES 1 | 5.0 | treated magnetic body | 65.0 | 120 | 100 | 120 |
| 22 | APES 10 | 15.0 | CPES 1 | 5.0 | treated magnetic body | 65.0 | 120 | 100 | 120 |
| 23 | APES 11 | 15.0 | CPES 1 | 5.0 | treated magnetic body | 65.0 | 120 | 100 | 120 |
| 24 | APES 12 | 15.0 | CPES 1 | 5.0 | treated magnetic body | 65.0 | 120 | 100 | 120 |
| 25 | APES 13 | 15.0 | CPES 1 | 5.0 | treated magnetic body | 65.0 | 120 | 100 | 120 |
| 26 | APES 14 | 15.0 | CPES 1 | 5.0 | treated magnetic body | 65.0 | 120 | 100 | 120 |
| 27 | APES 15 | 15.0 | CPES 1 | 5.0 | treated magnetic body | 65.0 | 120 | 100 | 120 |
| 28 | APES 16 | 15.0 | CPES 1 | 5.0 | treated magnetic body | 65.0 | 120 | 100 | 120 |
| 29 | APES 1 | 15.0 | CPES 5 | 5.0 | treated magnetic body | 65.0 | 120 | 1 | 120 |
| 30 | APES 17 | 15.0 | CPES 1 | 5.0 | treated magnetic body | 65.0 | 30 | 100 | 120 |
| 31 | | | | | described in text | | | | |
| 32 | APES 1 | 15.0 | CPES 1 | 5.0 | carbon black | 8.0 | 120 | 100 | 120 |
| comparative 1 | APES 18 | 15.0 | CPES 5 | 5.0 | treated magnetic body | 65.0 | 120 | 100 | 120 |

TABLE 4-continued

| toner base particle No. | amorphous polyester No. | amorphous polyester amount of addition [parts] | crystalline polyester No. | crystalline polyester amount of addition [parts] | colorant type | colorant amount of addition [parts] | holding time at 100° C. [minutes] | cooling rate [° C./minute] | holding time at 50° C. [minutes] |
|---|---|---|---|---|---|---|---|---|---|
| comparative 2 | APES 19 | 15.0 | CPES 1 | 5.0 | treated magnetic body | 65.0 | 30 | 100 | 120 |
| comparative 3 | APES 20 | 10.0 | CPES 6 | 5.0 | treated magnetic body | 65.0 | 120 | 1 | 120 |
| comparative 4 | | | | | described in text | | | | |
| comparative 5 | | | | | described in text | | | | |

* carbon black (product name: MA-100, Mitsubishi Chemical Corporation)

In the table, "holding time at 100° C." indicates a holding time at 100° C. after the polymerization step, "cooling rate" indicates a cooling rate to toner Tg or less (50° C.), and "holding time 50° C." indicates holding time at 50° C.

<Toner 1 Production Example>

100 parts of toner base particle 1 and 0.3 parts of sol-gel silica fine particles having a primary particle diameter of 115 nm were combined and mixed using a Henschel mixer (Mitsui Miike Chemical Engineering Machinery Co., Ltd.). This was followed by the addition of 0.9 parts of hydrophobic silica fine particles having a post-treatment BET specific surface area value of 120 $m^2/g$ and provided by the treatment of silica having a primary particle diameter of 12 nm with hexamethyldisilazane followed by treatment with silicone oil, and mixing using the Henschel mixer (Mitsui Miike Chemical Engineering Machinery Co., Ltd.) in the same manner to prepare a toner 1. The properties of toner 1 are given in Table 5.

<Production Example for Toners 2 to 32 and Comparative Toners 1 to 5>

Toners 2 to 32 and comparative toners 1 to 5 were obtained by changing the toner base particle, as shown in Table 5, in the production of toner 1. The properties are shown in Table 5.

TABLE 5

| Toner No. | toner base particle No. | D4 [μm] | Tg of toner [° C.] | softening point of toner [° C.] | APES domain diameter [μm] | presence/absence of CPES in the domain interior | lamellar structure of CPES in domain interior | 25% area ratio [area %] | 50% area ratio [area %] | domain area ratio | S211/S85 |
|---|---|---|---|---|---|---|---|---|---|---|---|
| 1 | 1 | 8.0 | 55 | 125 | 1.0 | present | present | 55 | 92 | 1.49 | 2.20 |
| 2 | 2 | 8.0 | 54 | 127 | 1.1 | present | present | 50 | 91 | 1.22 | 2.00 |
| 3 | 3 | 8.1 | 55 | 125 | 3.0 | present | present | 52 | 91 | 1.33 | 2.10 |
| 4 | 4 | 7.9 | 55 | 127 | 0.4 | present | present | 45 | 88 | 1.05 | 1.50 |
| 5 | 5 | 8.0 | 54 | 128 | 1.2 | present | present | 70 | 97 | 2.59 | 2.80 |
| 6 | 6 | 7.9 | 55 | 127 | 0.8 | present | present | 31 | 78 | 0.66 | 0.60 |
| 7 | 7 | 8.1 | 54 | 126 | 1.2 | present | present | 75 | 99 | 3.13 | 3.00 |
| 8 | 8 | 8.1 | 55 | 128 | 0.8 | present | present | 25 | 77 | 0.48 | 0.30 |
| 9 | 9 | 8.2 | 54 | 127 | 1.1 | present | present | 51 | 90 | 1.31 | 2.30 |
| 10 | 10 | 8.0 | 55 | 125 | 1.0 | present | present | 52 | 90 | 1.37 | 2.20 |
| 11 | 11 | 7.9 | 54 | 126 | 1.2 | present | present | 53 | 91 | 1.39 | 2.20 |
| 12 | 12 | 7.8 | 55 | 124 | 1.1 | present | present | 52 | 91 | 1.33 | 2.10 |
| 13 | 13 | 8.0 | 54 | 125 | 1.0 | present | present | 51 | 92 | 1.24 | 2.10 |
| 14 | 14 | 8.1 | 55 | 125 | 1.2 | present | present | 53 | 91 | 1.39 | 2.10 |
| 15 | 15 | 8.2 | 55 | 127 | 1.1 | present | present | 51 | 90 | 1.31 | 2.00 |
| 16 | 16 | 7.9 | 54 | 128 | 1.0 | present | present | 50 | 91 | 1.22 | 2.10 |
| 17 | 17 | 8.0 | 55 | 125 | 1.2 | present | present | 51 | 92 | 1.24 | 1.90 |
| 18 | 18 | 7.9 | 54 | 126 | 1.0 | present | present | 52 | 90 | 1.37 | 2.00 |
| 19 | 19 | 8.0 | 54 | 127 | 1.5 | present | present | 51 | 91 | 1.28 | 2.00 |
| 20 | 20 | 8.0 | 55 | 125 | 2.0 | present | present | 60 | 94 | 1.76 | 2.60 |
| 21 | 21 | 8.1 | 55 | 128 | 0.5 | present | present | 35 | 83 | 0.73 | 0.90 |
| 22 | 22 | 8.2 | 55 | 129 | 3.5 | present | present | 65 | 94 | 2.24 | 2.70 |
| 23 | 23 | 8.1 | 55 | 125 | 0.8 | present | present | 52 | 90 | 1.37 | 1.90 |
| 24 | 24 | 8.2 | 54 | 127 | 1.5 | present | present | 51 | 90 | 1.31 | 2.00 |
| 25 | 25 | 8.1 | 55 | 126 | 0.6 | present | present | 52 | 93 | 1.27 | 2.10 |
| 26 | 26 | 8.2 | 54 | 128 | 1.8 | present | present | 54 | 93 | 1.38 | 2.20 |
| 27 | 27 | 8.0 | 55 | 127 | 0.4 | present | present | 50 | 90 | 1.25 | 2.20 |
| 28 | 28 | 8.1 | 54 | 125 | 2.0 | present | present | 51 | 90 | 1.31 | 2.10 |
| 29 | 29 | 8.0 | 54 | 128 | 1.0 | present | not present | 50 | 91 | 1.22 | 2.20 |
| 30 | 30 | 7.9 | 55 | 128 | 2.1 | present | present | 52 | 92 | 1.30 | 2.30 |
| 31 | 31 | 8.1 | 55 | 127 | 0.5 | present | present | 20 | 40 | 1.00 | 0.22 |
| 32 | 32 | 8.1 | 55 | 125 | 1.1 | present | present | 50 | 91 | 1.22 | 2.30 |
| comparative 1 | comparative 1 | 8.0 | 54 | 124 | 0.5 | present | present | 53 | 93 | 1.33 | 2.20 |
| comparative 2 | comparative 2 | 7.9 | 54 | 125 | 0.3 | present | present | 51 | 91 | 1.28 | 2.10 |

TABLE 5-continued

| Toner No. | toner base particle No. | D4 [μm] | Tg of toner [° C.] | softening point of toner [° C.] | APES domain diameter [μm] | presence/ absence of CPES in the domain interior | lamellar structure of CPES in domain interior | 25% area ratio [area %] | 50% area ratio [area %] | domain area ratio | S211/ S85 |
|---|---|---|---|---|---|---|---|---|---|---|---|
| comparative 3 | comparative 3 | 8.0 | 54 | 128 | no domain | not present | not present | 95 | 99 | 23.75 | 3.50 |
| comparative 4 | comparative 4 | 8.2 | 55 | 124 | 0.5 | present | not present | 20 | 40 | 1.00 | 0.20 |
| comparative 5 | comparative 5 | 8.2 | 55 | 123 | 0.2 | not present | not present | 22 | 40 | 1.22 | 0.21 |

Example 1

A modified LBP7700C printer from Canon, Inc. was used in the image output evaluations. The modifications included the following: the toner-carrying member was changed to the toner-carrying member 1 described above; the toner feed member in the developing apparatus was made to undergo counter-rotation versus the toner-carrying member, as shown in FIG. 1; and the application of voltage to the toner feed member was turned off. In addition, the contact pressure was adjusted to bring the width of the contact region between the toner-carrying member and the electrostatic latent image-bearing member to 1.1 mm.

In addition, the voltage applied to the toner-carrying member was modified from the finished product condition to enable it to be 200 V higher than the finished product condition. (For example, if the voltage applied to the toner-carrying member in the finished product is −600 V, the condition of 200 V higher than the finished product condition is −400 V.)

In other modifications, the cleaning blade was removed, as shown in FIG. 2, and the process speed was modified to 25 ppm and 30 ppm.

Severe image-forming conditions are set up by making these modifications.

100 g of toner 1 was filled into the developing apparatus modified as indicated above and image evaluation was carried out in a low-temperature, low-humidity environment (15.0° C./10% RH).

Moreover, in the image evaluation, a horizontal line image having a print percentage of 1% was printed under a two-print intermittent paper feed. A transfer paper (areal weight=75 g/cm$^2$, Xerox Corporation) was used for the evaluations.

The evaluation methods and their scoring criteria are described below for each of the evaluations carried out in the present invention in the examples and comparative examples.

[On-Drum Fogging Post-Solid Black]

The fogging was measured using a Reflectometer Model TC-6DS from Tokyo Denshoku Co., Ltd. A green filter was used for the filter.

The fogging on the electrostatic latent image-bearing member was calculated by subtracting, from the reflectance (%) of Mylar tape pasted on the unused paper, the reflectance (%) provided when Mylar tape was taped on the electrostatic latent-image bearing member prior to the transfer of a solid white image (non-image area) immediately after the output of a solid black image and the Mylar tape was then pasted on the paper.

With regard to the timing of the evaluation, the on-drum fogging is evaluated at the 10th and 2,000th image formation. A score of C or better was considered excellent in the present invention.

A: less than 5.0%

B: at least 5.0% and less than 10.0%

C: at least 10.0% and less than 15.0%

D: at least 15.0%

[On-Drum Fogging Post-Heat Cycling]

A portion of toner 1 was held in a heat-cycling environment. The heat cycling conditions are as follows.

(1) Hold for 1 hour at 25° C.

(2) Raise the temperature at a constant ramp rate to 45° C. over 11 hours (3) Hold for 1 hour at 45° C.

(4) Lower the temperature at a constant cooling rate to 25° C. over 11 hours

Designating (1) to (4) as 1 cycle, a total of 20 cycles were carried out.

The fogging was then evaluated by the same procedure as in [On-drum fogging post-solid black] above. The timing of the evaluation was at the 100th image formation.

[Solid Image Chipping (Blank Dots)]

Fox River Bond paper (75 g/m$^2$) was used as the evaluation paper. For the solid image fixing performance, image output was carried out by printing a solid black image having a print percentage of 100% on the Fox River Bond paper at a fixation temperature of 190° C. Subsequent to this, image output was carried out by reducing the fixation temperature at the fixing unit in 5° C. steps from 190° C.

Solid image chipping (blank dots) was visually evaluated.

A: blank dots are produced at or below 165° C.

B: blank dots are produced at 170° C. to 175° C.

C: blank dots are produced at 180° C. to 185° C.

D: blank dots are produced at 190° C.

Examples 2 to 32

Image output evaluations were performed as in Example 1, but changing the toners as indicated in Table 6. According to the results, excellent images could be obtained that presented few image defects. The results of the evaluations are given in Table 6.

Comparative Examples 1 to 5

Image output evaluations were performed as in Example 1, but changing the toners as indicated in Table 6. Image defects were produced according to the results. The results of the evaluations are given in Table 6.

TABLE 6

| | | low-temperature, low-humidity environment post-black fogging | | | | | | normal-temperature, normal-humidity environment | |
|---|---|---|---|---|---|---|---|---|---|
| Example No. | toner No. | 10 (prints) | | 2000 (prints) | | post-heat cycling (100 prints) | | solid image chipping — | |
| 1 | 1 | A | 0.5 | A | 2.0 | A | 2.0 | A | 160 |
| 2 | 2 | A | 0.8 | A | 2.5 | A | 4.0 | A | 165 |
| 3 | 3 | A | 1.0 | A | 3.5 | B | 7.2 | A | 165 |
| 4 | 4 | A | 1.0 | B | 6.2 | B | 7.5 | A | 165 |
| 5 | 5 | A | 1.2 | B | 7.5 | B | 7.2 | A | 160 |
| 6 | 6 | A | 0.8 | A | 3.5 | A | 3.5 | B | 175 |
| 7 | 7 | A | 1.5 | B | 8.2 | B | 8.4 | A | 160 |
| 8 | 8 | A | 0.8 | A | 3.1 | A | 2.9 | C | 180 |
| 9 | 9 | A | 2.5 | B | 8.1 | C | 13.0 | A | 160 |
| 10 | 10 | A | 0.9 | A | 2.1 | A | 3.2 | B | 175 |
| 11 | 11 | A | 3.2 | B | 6.8 | C | 14.5 | A | 160 |
| 12 | 12 | A | 0.9 | A | 2.0 | A | 3.1 | C | 180 |
| 13 | 13 | A | 1.2 | B | 6.4 | B | 6.5 | A | 165 |
| 14 | 14 | A | 2.3 | B | 6.7 | B | 6.9 | A | 165 |
| 15 | 15 | A | 2.4 | A | 4.1 | B | 6.1 | B | 175 |
| 16 | 16 | A | 3.4 | B | 7.5 | A | 4.9 | A | 160 |
| 17 | 17 | A | 2.2 | A | 3.8 | B | 5.9 | C | 185 |
| 18 | 18 | A | 3.9 | B | 8.6 | C | 10.1 | A | 160 |
| 19 | 19 | A | 3.7 | B | 8.4 | C | 11.2 | A | 165 |
| 20 | 20 | A | 2.8 | B | 6.4 | B | 7.6 | A | 165 |
| 21 | 21 | A | 3.2 | B | 7.2 | B | 7.3 | A | 165 |
| 22 | 22 | A | 3.2 | B | 7.6 | C | 10.2 | A | 165 |
| 23 | 23 | A | 2.3 | B | 6.2 | B | 8.4 | A | 160 |
| 24 | 24 | A | 1.5 | A | 4.5 | B | 8.2 | B | 175 |
| 25 | 25 | A | 2.4 | B | 8.2 | B | 9.2 | A | 160 |
| 26 | 26 | A | 1.8 | A | 4.7 | B | 9.1 | B | 175 |
| 27 | 27 | A | 2.7 | B | 9.2 | C | 10.3 | A | 160 |
| 28 | 28 | A | 1.9 | A | 4.7 | C | 10.1 | C | 180 |
| 29 | 29 | B | 5.1 | C | 13.1 | C | 14.5 | A | 165 |
| 30 | 30 | B | 5.8 | B | 8.1 | B | 8.2 | A | 165 |
| 31 | 31 | B | 5.5 | C | 12.4 | C | 14.8 | C | 180 |
| 32 | 32 | A | 0.5 | A | 2.4 | A | 2.5 | A | 160 |
| Comparative 1 | Comparative 1 | B | 6.1 | C | 12.3 | D | 16.5 | A | 165 |
| Comparative 2 | Comparative 2 | B | 7.2 | C | 14.1 | D | 17.1 | A | 165 |
| Comparative 3 | Comparative 3 | B | 5.9 | D | 15.2 | D | 16.2 | A | 165 |
| Comparative 4 | Comparative 4 | B | 6.1 | D | 16.3 | D | 18.2 | C | 185 |
| Comparative 5 | Comparative 5 | B | 5.2 | C | 14.7 | B | 8.5 | D | 190 |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-130177, filed Jun. 30, 2016, which is hereby incorporated by reference herein in its entirety.

What is claimed is:

1. A toner comprising a toner particle containing a binder resin, a colorant, an amorphous polyester, and a crystalline polyester, the binder resin containing a vinyl resin, the amorphous polyester having a monomer unit derived from a linear aliphatic dicarboxylic acid having at least 6 and not more than 12 carbons, and a monomer unit derived from a dialcohol, the content of the monomer unit derived from the linear aliphatic dicarboxylic acid having at least 6 and not more than 12 carbons being at least 10 mol % and not more than 50 mol % with reference to the total monomer units derived from a carboxylic acid in the amorphous polyester, and in a cross section of the toner particle observed with a transmission electron microscope, the vinyl resin constituting a matrix and the amorphous polyester constituting domains, and the crystalline polyester being present in the interior of the domains.

2. The toner according to claim 1, wherein the amorphous polyester domains have in their interior a lamellar structure derived from the crystalline polyester.

3. The toner according to claim 1, wherein the peak molecular weight Mp(P) of the amorphous polyester is at least 8,000 and not more than 13,000, and the softening point of the amorphous polyester is at least 85° C. and not more than 105° C.

4. The toner according to claim 1, wherein the amorphous polyester has, in terminal position, a structure derived from at least one selected from the group consisting of aliphatic monocarboxylic acids having a peak value for the number of carbons of at least 25 and not more than 102 and aliphatic monoalcohols having a peak value for the number of carbons of at least 25 and not more than 102.

5. The toner according to claim 1, wherein the content of the amorphous polyester is at least 5.0 mass parts and not more than 30.0 mass parts per 100 mass parts of the binder resin.

6. The toner according to claim 1, wherein the main component of the crystalline polyester is a polyester that has, in terminal position, a structure derived from an acid monomer selected from lauric acid, stearic acid, and behenic acid.

7. The toner according to claim 1, wherein the content of the crystalline polyester is at least 3.0 mass parts and not more than 15.0 mass parts per 100 mass parts of the binder resin.

8. The toner according to claim 1, wherein, in a cross section of the toner particle observed with a transmission electron microscope, the proportion of the amorphous polyester domains present in a region within 25% of a distance, from the contour of the cross section, between the contour and a center point of the cross section is at least 30 area % and not more than 70 area % with reference to the total area of the amorphous polyester domains.

9. The toner according to claim 1, wherein, in a cross section of the toner particle observed with a transmission electron microscope, the proportion of the amorphous polyester domains present in a region within 50% of a distance, from the contour of the cross section, between the contour and a center point of the cross section is at least 80 area % and not more than 100 area % with reference to the total area of the amorphous polyester domains.

10. The toner according to claim 1, wherein, in a cross section of the toner particle observed with a transmission electron microscope, the area of the amorphous polyester domains present within 25% of the distance, from the contour of the cross section, between the contour and the center point of the cross section, is at least 1.05 times the area of the amorphous polyester domains present at 25% to 50% of the distance, from the contour of the cross section, between the contour and the center point of the cross section.

11. The toner according to claim 1, wherein the number-average diameter of the domains is at least 0.3 μm and not more than 3.0 μm.

12. The toner according to claim 1, wherein the softening point of the toner is at least 110° C. and not more than 140° C.

13. A developing apparatus comprising:

a toner that develops an electrostatic latent image formed on an image-bearing member; and a toner-carrying member that carries the toner and transports the toner to the image-bearing member, wherein the toner is the toner described in claim 1.

14. An image-forming apparatus comprising:

an image-bearing member;

a charging member that charges the image-bearing member;

a toner that develops an electrostatic latent image formed on the image-bearing member; and a toner-carrying member that contacts the image-bearing member and transports the toner, the image-forming apparatus recovering, using the toner-carrying member, toner remaining on the image-bearing member after transfer, wherein the toner is the toner described in claim 1.

* * * * *